US005689780A

United States Patent [19]

Tamura et al.

[11] Patent Number: 5,689,780

[45] Date of Patent: Nov. 18, 1997

[54] ELECTROPHOTOGRAPHIC COLOR PRINTING APPARATUS USING SUCCESSIVELY ENGAGEABLE DEVELOPING UNITS

[75] Inventors: Yoshihiro Tamura, Tokyo; Hidetoshi Hara; Jun Inagaki, both of Otsu, all of Japan

[73] Assignee: Toray Industries, Inc., Tokyo, Japan

[21] Appl. No.: 656,805

[22] Filed: May 31, 1996

Related U.S. Application Data

[62] Division of Ser. No. 307,772, filed as PCT/JP94/00103, Jan. 26, 1994, abandoned.

[30] Foreign Application Priority Data

Jan. 27, 1993 [JP] Japan ..... 5-11949

[51] Int. Cl.[6] ..... G03G 15/10

[52] U.S. Cl. ..... 399/249

[58] Field of Search ..... 355/256, 259; 118/661; 399/249

[56] References Cited

U.S. PATENT DOCUMENTS

| | | | |
|---|---|---|---|
| 4,056,315 | 11/1977 | Ariyama et al. | 15/256 |
| 4,205,622 | 6/1980 | Miyake et al. | 118/661 |
| 4,227,797 | 10/1980 | Tsunoi | 355/256 |
| 4,325,627 | 4/1982 | Swidler et al. | 355/256 |
| 4,353,639 | 10/1982 | Moraw et al. | 355/256 |
| 5,150,161 | 9/1992 | Bujese | 355/256 |
| 5,158,846 | 10/1992 | Bujese | 430/47 |
| 5,187,526 | 2/1993 | Zaretsky | 355/273 |
| 5,278,615 | 1/1994 | Landa | 355/256 |
| 5,280,326 | 1/1994 | Pinhas et al. | 355/273 |
| 5,291,251 | 3/1994 | Storlie et al. | 355/271 |
| 5,424,813 | 6/1995 | Schlueter, Jr. et al. | 355/256 |
| 5,477,313 | 12/1995 | Kuramochi et al. | 355/256 |

FOREIGN PATENT DOCUMENTS

| | | | |
|---|---|---|---|
| 52-46840 | 4/1977 | Japan . | |
| 52-60841 | 5/1977 | Japan . | |
| 54-145534 | 11/1979 | Japan . | |
| 55-55376 | 4/1980 | Japan . | |
| 61-77866 | 4/1986 | Japan . | |
| 2-289876 | 12/1987 | Japan . | |
| 62-296177 | 12/1987 | Japan . | |
| 1-159679 | 6/1989 | Japan . | |
| 1-206379 | 8/1989 | Japan . | |
| 1-206387 | 8/1989 | Japan . | |
| 1-301279 | 12/1989 | Japan . | |
| 0123383 | 5/1990 | Japan | 355/256 |
| 4-069693 | 3/1992 | Japan | 355/256 |
| 4-242772 | 8/1992 | Japan | 355/256 |
| 5-019634 | 1/1993 | Japan | 355/256 |

*Primary Examiner*—William J. Royer

*Attorney, Agent, or Firm*—Birch, Stewart, Kolasch & Birch, LLP

[57] ABSTRACT

An electrophotographic printer includes a photosensitive drum, an exposure device for successively forming a plurality of electrostatic latent images based on the color-separated print information on the photosensitive drum and a developing device for successively developing the electrostatic latent images into toner images by toners of different colors corresponding to the print information. An intermediate transfer medium is pressed against the photosensitive drum so that the toner images on the photosensitive drum are successively transferred to the intermediate transfer medium to form a multicolor toner image on the intermediate transfer medium. A transporting medium is used for feeding and delivering a recording medium, which the multicolor toner image formed on the intermediate transfer medium is to be transferred to and fixed on, to and from the intermediate transfer medium. A and heating-fixing device is pressed against the intermediate transfer medium via the recording medium, in which a plurality of electrostatic latent images based on the print information color-separated into yellow, magenta, cyan, and black are successively formed on the photosensitive drum. The electrostatic latent images are successively developed into toner images by toners of different colors corresponding to the color-separated print information. The process in which the toner images are transferred to the intermediate transfer medium is repeated successively to form a multicolor toner image thereon, and the multicolor toner image is transferred to and fixed on the recording medium.

11 Claims, 15 Drawing Sheets

ELECTROPHOTOGRAPHIC COLOR PRINTING APPARATUS USING SUCCESSIVELY ENGAGEABLE DEVELOPING UNITS

This application is a divisional of application Ser. No. 08/307,772, filed as PCT/JP94/00103, Jan. 26, 1994, now abandoned, the entire contents of which are hereby incorporated by reference.

TECHNICAL FIELD

The present invention relates to an electrophotographic printer and an electrophotographic printing method and, more particularly to an electrophotographic printer and an electrophotographic printing method, in which wet toner is used and an intermediate transfer medium such as an intermediate transfer drum is provided.

BACKGROUND ART

Electrophotographic printers are designed so that electrostatic latent images formed on a photosensitive drum are developed by means of toner, and the resulting toner images are heated under pressure and fixed on a recording medium, such as paper, by using a heating roll or other transfer means.

Some of these electrophotographic printers are provided with intermediate transfer means, such as a belt or drum, which can transfer the toner images to various recording media, including paper, plastic films, metal sheets, etc. The conventional electrophotographic printers furnished with the intermediate transfer means include, for example, an apparatus described in Unexamined Japanese Patent Publication (KOKAI) No. 50-23234 and an apparatus described in Examined Japanese Patent Publication (KOKOKU) No. 57-20632. The former is a wet developing type which uses wet toner, while the latter is a dry developing type which uses dry toner. In the latter type, moreover, a belt is used as the intermediate transfer means. An electrophotographic printer described in Unexamined Japanese Patent Publication (KOKAI) No. 63-34573 is known as an example of the wet developing type which uses a belt as the intermediate transfer means.

The electrophotographic printer of wet developing type using wet toner, which can use fine toner particles of submicron order, has an advantage of being able to produce sharper images of higher resolution over the dry developing type.

In making a color print by using such an electrophotographic printer, an electrostatic latent image corresponding to one color, e.g., magenta, is formed on the photosensitive drum, and is developed by means of magenta wet toner. Then, the resulting magenta toner image is transferred to the intermediate transfer means, e.g., an intermediate transfer drum, which is pressed against the photosensitive drum. Thereafter, cyan and yellow toner images are successively transferred in layers to the intermediate transfer drum in like manner to form a multicolor toner image. Subsequently, a heating roll is pressed against the intermediate transfer drum, the multicolor toner image on the intermediate transfer drum is transferred to and fixed on paper or some other recording medium, thus forming the color print.

However, the conventional electrophotographic printer and electrophotographic printing method have a number of problems to be solved. In obtaining clear color print, the transfer performance of a multicolor toner image from the photosensitive drum to the intermediate transfer drum is not always satisfactory. Further, the electrophotographic printer is provided with cleaning means for cleaning a residue of multicolor toner image remaining on the photosensitive drum after transfer; however, such cleaning means shortens the life of the photosensitive drum because the cleaning means uses a physical cleaning method in which cleaning is carried out by pressing a rubber blade, called a cleaning blade, on the photosensitive drum. Still further, from the viewpoint of expecting wide use of electrophotographic printers, maintenance-free operation is demanded if possible, for example, by reducing the frequency of toner change or by simplifying the toner change method on the user side in changing the developing toner. Still further, wet toner is produced by dispersing fine toner particles in a liquid carrier; therefore, unless the surplus liquid contained in the toner image transferred to the intermediate transfer drum is removed as much as possible, a large amount of vaporized gas resulting from the liquid carrier is generated at the final stage at which the multicolor toner image is fixed on the recording medium, resulting in leakage of the vaporized gas out of the electrophotographic printer.

DISCLOSURE OF THE INVENTION

The present invention has been made to solve the above problems. An object of the present invention is to provide an electrophotographic printer and an electrophotographic printing method, in which the transfer performance of multicolor toner image from a photosensitive drum to an intermediate transfer drum is excellent, cleaning means is provided which can clean the photosensitive drum without impairing the life thereof, toner can be changed easily, and the generation of vaporized gas resulting from a liquid carrier is held to the smallest possible extent.

To achieve the above object, the present invention provides an electrophotographic printer including: a photosensitive drum; exposure means for successively forming a plurality of electrostatic latent images based on print information color-separated into yellow, magenta, cyan, and black on the photosensitive drum with the yellow image being formed first; developing means for successively developing the electrostatic latent images on the photosensitive drum into toner images in the order of formation of electrostatic latent images by means of toners of different colors corresponding to the color-separated print information; an intermediate transfer medium pressed against the photosensitive drum so that the toner images on the photosensitive drum are successively transferred to the intermediate transfer medium in the order of development of toner images to form a multicolor toner image thereon; transportation means for feeding and delivering a recording medium, which the multicolor toner image formed on the intermediate transfer medium is to be transferred to and fixed on, to and from the intermediate transfer medium; and heating-fixing means pressed against the intermediate transfer medium via the recording medium. The electrostatic latent images are preferably formed in the order of yellow, magenta, cyan, and black.

Preferably, the developing means is a wet developing type using wet toners.

Preferably, a cleaning roller, which has an insulating layer on the surface of an electrically conductive roller, has a peripheral speed equal to that of the photosensitive drum, and rotates in the direction opposite to the photosensitive drum, for cleaning the surface of the photosensitive drum after the toner image is transferred to the intermediate transfer medium is brought into contact with the photosensitive drum.

Further preferably, means for applying a bias voltage which is opposite in polarity to the toner is connected to the cleaning roller.

Preferably, the cleaning roller is provided with charging means for charging the cleaning roller to the polarity opposite to that of the toner, on the upstream side of the contact portion, where the cleaning roller is in contact with the photosensitive drum, with respect to the rotating direction of the cleaning roller.

Preferably, the photosensitive drum is provided with potential control means on the upstream side of the contact portion with respect to the rotating direction of the photosensitive drum.

Preferably, the developing means includes a plurality of developing units arranged in a row and having respective developing rollers and squeeze rollers which are urged against the photosensitive drum, each of these developing units is removably provided with a toner cartridge containing wet toner of a color corresponding to the color-separated print information, and each electrostatic latent image on the photosensitive drum is successively developed by successively moving each developing unit in the tangential direction of the photosensitive drum.

Further preferably, the toner cartridge has a lower tank for containing the wet toner and an upper tank for containing a wet toner for replenishment, and is provided with a rolling member for stirring the wet toner for replenishment at the bottom of the upper tank.

Preferably, the photosensitive drum is provided with an auxiliary squeeze roller on the downstream side of the developing means with respect to the rotating direction of the photosensitive drum.

Further preferably, the intermediate transfer medium is provided with liquid absorbing means for absorbing surplus liquid on the surface of the intermediate transfer medium, on the downstream side of the pressing portion, where the intermediate transfer medium is pressed against the photosensitive drum, with respect to the moving direction of the intermediate transfer medium.

Also, to achieve the above object, the present invention provides an electrophotographic printing method including the steps of successively forming a plurality of electrostatic latent images based on print information color-separated into yellow, magenta, cyan, and black, on a photosensitive drum, with yellow image being formed first; successively developing the electrostatic latent images into toner images in the order of formation of electrostatic latent images by means of toners of different colors corresponding to the color-separated print information; forming a multicolor toner image on an intermediate transfer medium by successively repeating the process in which the toner images are transferred to the intermediate transfer medium in the order of development; and transferring and fixing the multicolor toner image to and on a recording medium. The electrostatic latent images are preferably formed in the order of yellow, magenta, cyan, and black.

Preferably, the electrostatic latent images are developed by a wet developing method using wet toners.

Preferably, the surface of the photosensitive drum is cleaned after the toner images are transferred to the intermediate transfer medium.

Preferably, surplus liquid is removed from the surface of the photosensitive drum after development.

Further preferably, surplus liquid on the surface of the intermediate transfer medium is absorbed after the toner images are transferred.

In the electrophotographic printer and the electrophotographic printing method in accordance with the present invention, the process in which the toner images formed on the photosensitive drum are transferred to the intermediate transfer medium is successively repeated in the order of yellow, magenta, cyan, and black to form a multicolor toner image on the intermediate transfer medium, by which the multicolor toner image is transferred to and fixed on the recording medium.

At this time, if the developing means is a wet type, sharp images with high resolution can be obtained. Since the colors of the toner images developed corresponding to the color-separated print information are yellow, magenta, cyan, and black, and the yellow-colored toner image is first developed, yellow toner image is fixed on the uppermost layer on recording medium. Since the yellow toner has higher light transmission than the toner of any other color, the resultant color image is clear, so that the print quality can be improved. The yellow toner image, being located on the lowermost layer on the intermediate transfer drum, has the highest possibility of remaining on the intermediate transfer medium without being transferred to the recording medium. However, the yellow toner image need not be cleaned because it is not so conspicuous.

If the cleaning roller, which has an insulating layer on the surface of an electrically conductive roller, has a peripheral speed equal to that of the photosensitive drum, and rotates in the direction opposite to the photosensitive drum, for cleaning the surface of the photosensitive drum after the toner image is transferred to the intermediate transfer medium is brought into contact with the photosensitive drum, the life of the photosensitive drum increases as compared with the case where physical cleaning is performed by pressing a cleaning blade etc. against the photosensitive drum, the rotation of the photosensitive drum becomes smooth, and the chattering vibration due to the pressing of the blade does not occur, by which the print quality is improved and the toner images remaining on the photosensitive drum is effectively cleaned.

If the means for applying a bias voltage which is opposite in polarity to the toner is connected to the cleaning roller, the electrostatic cleaning efficiency of the toner images remaining on the photosensitive drum is improved.

Also, if the cleaning roller is provided with the charging means for charging the cleaning roller to the polarity opposite to that of the toner, on the upstream side of the contact portion, where the cleaning roller is in contact with the photosensitive drum, or the photosensitive drum is provided with potential control means on the upstream side of the contact portion, the same effect can be achieved.

Further, if the developing means includes the plural developing units arranged in a row and having respective developing rollers and squeeze rollers which are urged against the photosensitive drum, each of these developing units is removably provided with the toner cartridge containing wet toner of a color corresponding to the color-separated print information, and each electrostatic latent image on the photosensitive drum is successively developed by successively moving each developing unit in the tangential direction of the photosensitive drum, toner can be changed easily merely by attaching/detaching the toner cartridge.

If the toner cartridge has the lower tank for containing the wet toner and the upper tank for containing the wet toner for replenishment, and is provided with the rolling member for stirring the wet toner for replenishment at the bottom of the upper tank, the movement of developing units due to the development of toner image causes the rolling member to roll on the bottom to stir the wet toner for 0.1h12 replenishment, by which the concentration of wet toner for replenishment becomes uniform.

If the photosensitive drum is provided with the auxiliary squeeze roller on the downstream side of the developing means with respect to the rotating direction of the photosensitive drum, surplus liquid can be removed from the developed toner image.

If the intermediate transfer medium is provided with the liquid absorbing means for absorbing surplus liquid on the surface of the intermediate transfer medium, on the downstream side of the pressing portion, where the intermediate transfer medium is pressed against the photosensitive drum, with respect to the moving direction of the intermediate transfer medium, surplus liquid contained in the toner image transferred from the photosensitive drum is removed effectively.

If the squeeze roller of the developing means and the auxiliary squeeze roller are set so that the contact angle at which the wet toner is in contact with the surfaces of the these rollers is smaller than the contact angle at which it is in contact with the surface of the photosensitive drum, surplus wet toner can be removed more effectively from the photosensitive drum on which toner images are developed.

DESCRIPTION OF THE PREFERRED EMBODIMENTS

An electrophotographic printer and an electrophotographic printing method according to one embodiment of the present invention will now be described in detail with reference to the accompanying drawings.

Figure 1:
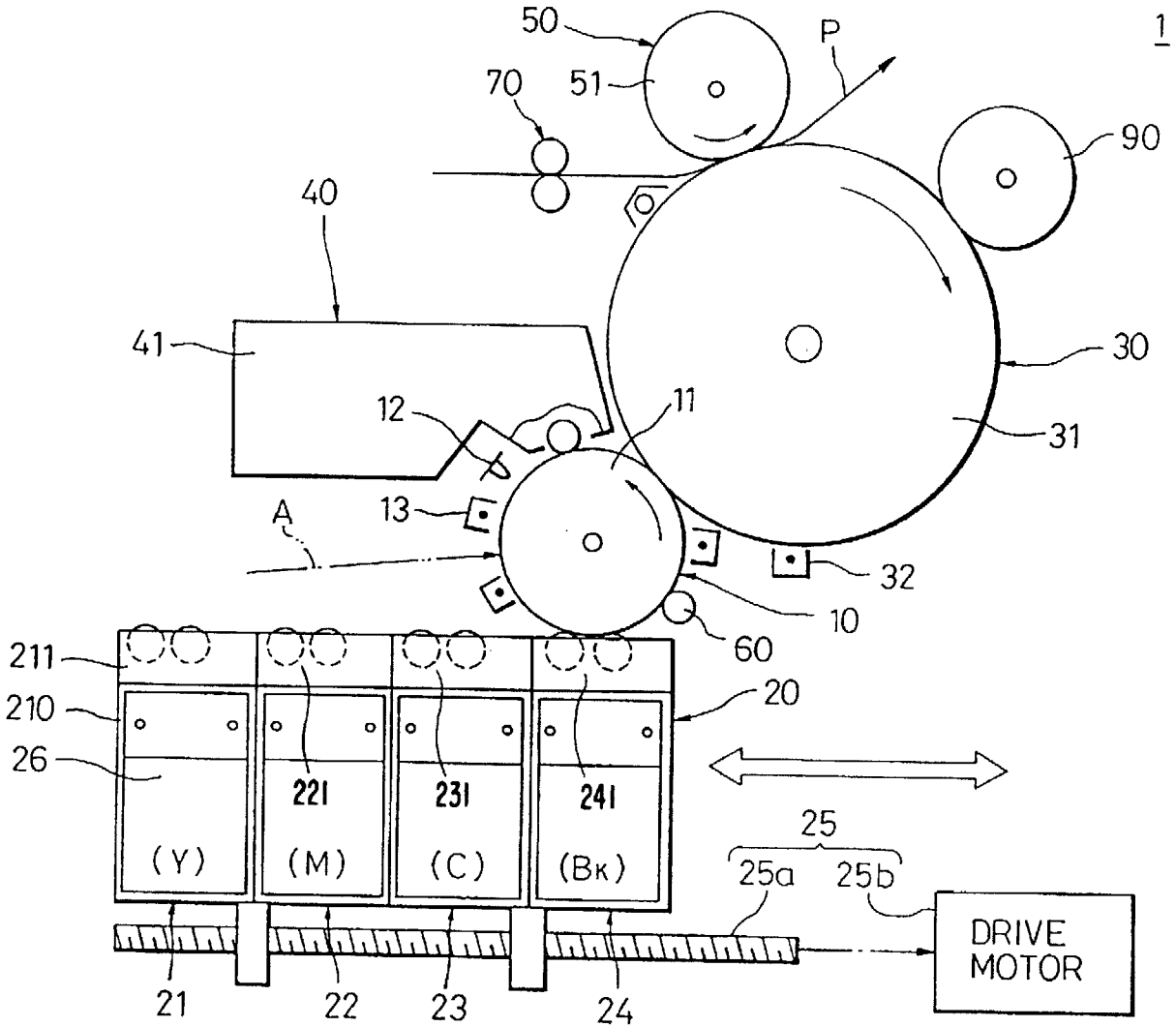
FIG. 1 is a general view showing one embodiment of an electrophotographic printer in accordance with the present invention.

Referring first to FIG. 1, the outline of the electrophotographic printer according to the present invention will be described. The electrophotographic printer 1 includes photosensitive means 10, developing means 20, intermediate transfer means 30, cleaning means 40, transfer means 50, an auxiliary squeeze roller 60, a paper feeder unit 70, an exposure system (not shown) for radiating exposure light in the direction of arrow A. The other arrows in FIG. 1 indicate the respective rotating directions of the individual members.

FIG. 1 is a front view of the electrophotographic printer 1. In the description to follow, the side shown in FIG. 1 will be referred to as the front side, and the side corresponding to the reverse side of the drawing as the rear side.

The photosensitive means 10 includes a photosensitive drum 11, a discharger 12 for removing residual electric charge from the photosensitive drum 11, and a charger 13 for uniformly charging the photosensitive drum 11. Before removing the residual electric charge, the surface of the drum 11 is cleaned by using the cleaning means 40. The cleaning means 40, discharger 12, and charger 13 are arranged between the intermediate transfer means 30 and the developing means 20, in the order named along the rotating direction of the photosensitive drum 11.

The photosensitive drum 11 is a cylindrical drum member, on the surface of which is formed a photosensitive medium layer of an organic photoconductor (OPC). Besides the OPC, a selenium (Se)-based material, amorphous silicon ($\alpha$-Si), etc. may be used as the material of the photosensitive medium layer. The discharger 12, which may be an LED array or a miniature incandescent light bulb, applies light to the surface of the photosensitive drum 11, thereby erasing the residual latent image. The charger 13 uniformly charges the photosensitive drum 11 with ions produced by corona discharge.

The exposure system, which is used to form an electrostatic latent image on the surface of the photosensitive drum 11, includes a laser light source, a liquid-crystal shutter, etc. The exposure system applies a laser beam to the surface of the photosensitive drum 11 in the direction of arrow A in accordance with print information corresponding to each color of a color document, thereby forming the electrostatic latent images corresponding to the print information on the drum surface. An LED array may be used as the exposure means for applying the print information to the surface of the photosensitive drum 11.

The developing means 20 includes first to fourth developing units 21 to 24 arranged horizontally therein along the traveling direction, drive means 25 for moving the developing units 21 to 24 in a body horizontally in the transverse direction indicated by the arrow in FIG. 1, which is the tangential direction of the photosensitive drum 11, and toner cartridges 26 provided for the respective units 21 to 24 and removably set in a housing 210. The drive means 25 includes a ball screw 25*a* and a drive motor 25*b*. The first developing unit 21 is formed with a liquid tank 211 for wet toner at the upper portion of the housing 210. Housed in the lower portion of the unit 21 is a toner cartridge 26 which contains a wet toner of one color. A developing roller 212 and a squeeze roller 213 are arranged at a predetermined distance from each other in the liquid tank 211, extending in a parallel relation.

The developing units 21 to 24 of the developing means 20 have their respective toner cartridges 26 individually containing wet toners of yellow, magenta, cyan, and black. Before the start of a developing operation, the developing means 20 is located at a predetermined position on the right of the photosensitive drum 11 as viewed in the figure. When performing the developing operation, the developing units 21, 22, 23 and 24 are successively moved toward the photosensitive means 10 in the order named, by using the drive means 25, and the electrostatic latent images formed on the basis of the color-separated print information are developed in succession. Each wet toner used is formed of toner particles of yellow, magenta, cyan, etc. dispersed in a liquid carrier.

The developing units, which will be described in detail later, are constructed in the same manner. In the description to follow, therefore, like or corresponding reference numerals are used to designate like or corresponding portions of the individual developing units throughout the drawings for simplicity of illustration.

The intermediate transfer means 30 includes an intermediate transfer drum 31 and a charger 32 disposed along the rotating direction of the intermediate transfer drum 31. The toner images successively developed by the developing means 20 are successively transferred in layers to the surface of the intermediate transfer drum 31.

The intermediate transfer drum 31 may consist of a cylindrical metallic drum on the surface of which a thin insulating silicone resin layer is formed, or a metallic drum around which a silicone resin layer formed on a conductive base is wound. A better transfer performance can be obtained by providing a suitable cushion layer under the silicone resin layer. The intermediate transfer drum 31 is pressed against the photosensitive drum 11 every time the toner images of the individual colors are developed by the developing means 20. Thus the toner images of the individual colors are successively transferred in layers. The drum 31 may have various suitable diameters, depending on the size of the recording medium used. When the recording medium is large-sized, the diameter of the drum 31 is greater than that of the photosensitive drum 11 as shown in FIG. 1.

The charger 32 charges the intermediate transfer drum 31 on the basis of the same principle for the charger 13 of the photosensitive means 10, and cancels the influence of the previous toner image, thereby facilitating the transfer of the next toner image of a different color from the photosensitive drum 11. Also, the charger 32 prevents the toner images already transferred to the intermediate transfer drum 31 from returning to the surface of the photosensitive drum 11.

In the intermediate transfer means 30, the toner images developed on the photosensitive drum 11 are charged by the charger 32 as they are successively transferred in layers to the intermediate transfer drum 31. In this process, some toner images and wet toners remain on the photosensitive drum 11 without having been transferred to the intermediate transfer drum 31. These residues are removed by the cleaning means 40. Assuming that the color of toner image first developed on the photosensitive drum 11 is yellow (Y), among the aforementioned wet toners of yellow (Y), magenta (M), cyan (C), and black (Bk), yellow toner image is fixed on the uppermost layer on transfer paper P. Since the yellow toner has higher light transmission than the toner of any other color, the resultant color image is clear, so that the print quality can be improved. The yellow toner image, being located on the lowermost layer on the intermediate transfer drum 31, has the highest possibility of remaining on the intermediate transfer drum 31 without being transferred to the transfer paper P. However, the yellow toner image need not be cleaned because it is not so conspicuous.

The cleaning means 40 includes a cleaning roller 42 which is disposed in a cartridge 41. When the cleaning means 40 is set in the electrophotographic printer 1, the cleaning roller 42 comes into contact with the photosensitive drum 11. The cleaning means 40 cleans the photosensitive drum 11 in such a manner that the residual toner images and wet toners left on the drum 11 after the image transfer to the intermediate transfer drum 31 are electrostatically attracted and collected by means of the cleaning roller 42, scraped up by a rubber blade formed of urethane rubber etc. and recovered into a toner recovery vessel. The construction of the cleaning means 40 will be described in detail later.

The transfer means 50 includes a heating roll 51, having a heater (not shown) therein, and a push mechanism mentioned later. The heating roll 51, which is pressed against the intermediate transfer drum 31 by the push mechanism, heats and pressurizes a multicolor toner image transferred to the intermediate transfer drum 31, and fixes the image on the transfer paper P.

In transferring the toner images from the photosensitive drum 11 to the intermediate transfer drum 31, the push mechanism keeps the heating roll 51 apart from the intermediate transfer drum 31. Before that portion of the drum 31 to which the last toner image, among the four different-colored toner images, has been transferred is reached, the push mechanism presses the heating roll 51 against the intermediate transfer drum 31 with a predetermined force of pressure. Thereupon, the heating roll 51 heats and pressurizes the multicolor toner image transferred to the intermediate transfer drum 31, and transfers to and fixes the image on the transfer paper P fed from the paper feeder unit 70.

The auxiliary squeeze roller 60 is disposed between the developing means 20 and the intermediate transfer means 30 with a space of, e.g., 30 μm secured between the roller 60 and the photosensitive drum 11. The roller 60 serves to remove surplus wet toners overflowing the space, especially the liquid carrier, from the surface of the photosensitive drum 11 on which the toner images are developed, by turning in the same direction as the photosensitive drum 11. A squeeze corona charger may be used in place of the auxiliary squeeze roller 60 with the same effect.

The paper feeder unit 70 supplies the transfer paper P to the space between the intermediate transfer drum 31 and the heating roll 51 when the laminated toner image on the drum 31 is fixed.

The electrophotographic printer 1 of the present invention, constructed in this manner, makes a color print as described below.

First, the residual electric charge is removed, by means of the discharger 12, from the surface of the photosensitive drum 11, which has been cleaned by the cleaning means 40, and the drum surface is uniformly charged by means of the charger 13.

Then, the laser beam is applied to the photosensitive drum 11 as indicated by arrow A in FIG. 1, so that the electrostatic latent images corresponding to the color-separated print information are successively formed on the surface of the photosensitive drum 11. These laser-beam-originated latent images are formed four times in total, corresponding to the colors of yellow, magenta, cyan, and black.

Subsequently, the ball screw 25*a* is rotated by the drive motor 25*b*, and the developing means 20, which has so far been located on the right of the photosensitive drum 11 in FIG. 1, is moved horizontally. Thereupon, yellow, magenta, cyan, and black toner images are successively developed by the first, second, third, and fourth developing units 21, 22, 23, and 24, respectively. The toner images, thus developed by their corresponding developing units 21 to 24, are transferred in succession to the intermediate transfer drum 31. As a result, a multicolor toner image, in which four-colored toner images are laminated, is formed on the intermediate transfer drum 31.

As the toner image developed by the fourth developing unit 24 is transferred to the intermediate transfer drum 31, or after the transfer is completed, the push mechanism presses the heating roll 51 against the drum 31. As a result, the multicolor toner image on the intermediate transfer drum 31 is heated under pressure and fixed on the transfer paper P, thus completing one process of color print formation.

Referring now to FIGS. 2 to 11, the developing unit 21, driving means 25, and toner cartridge 26 of the developing means 20 will be described.

Figure 2:
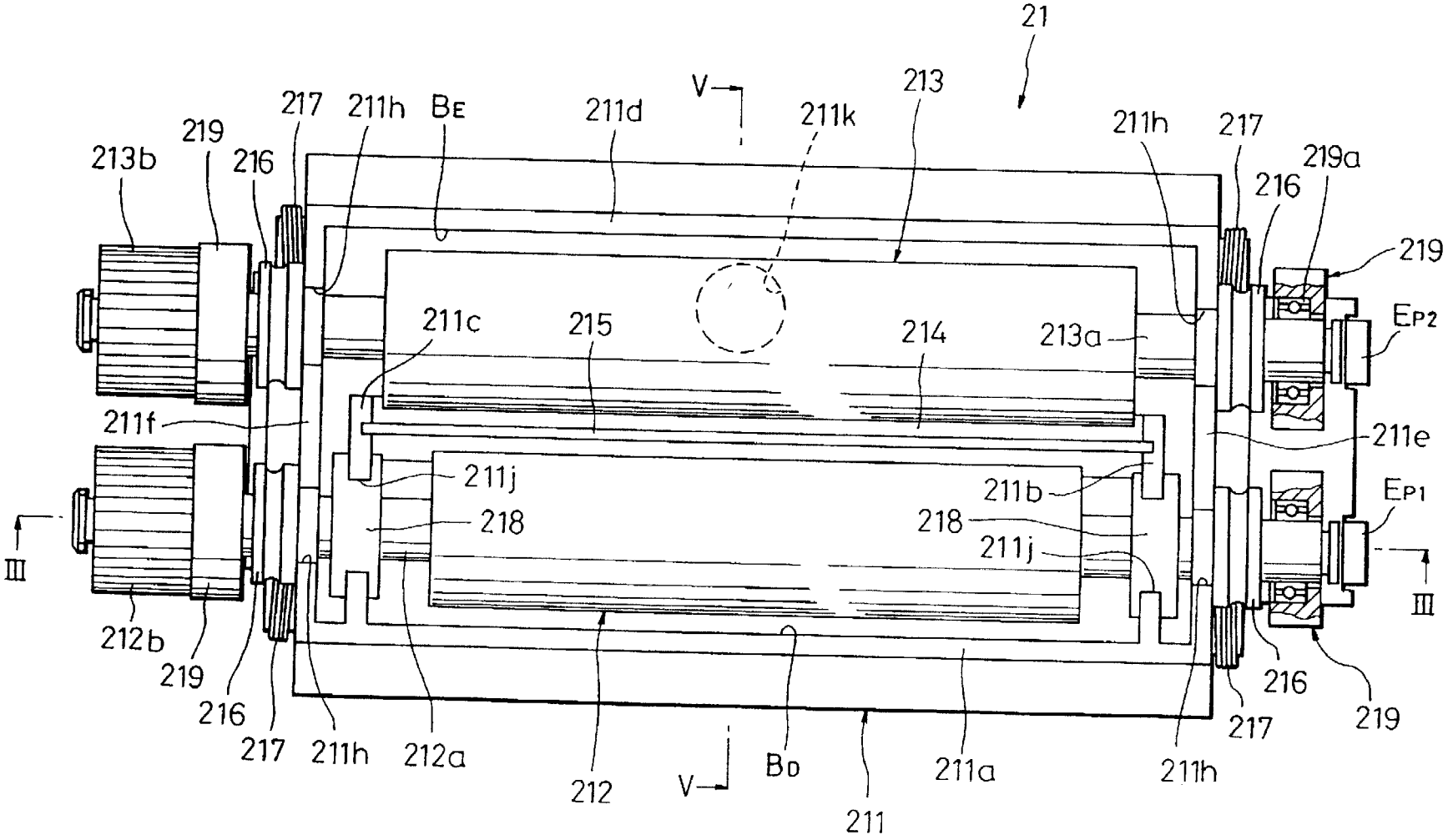
FIG. 2 is a plan view showing a developing roller and a squeeze roller included in developing means.
Figure 3:
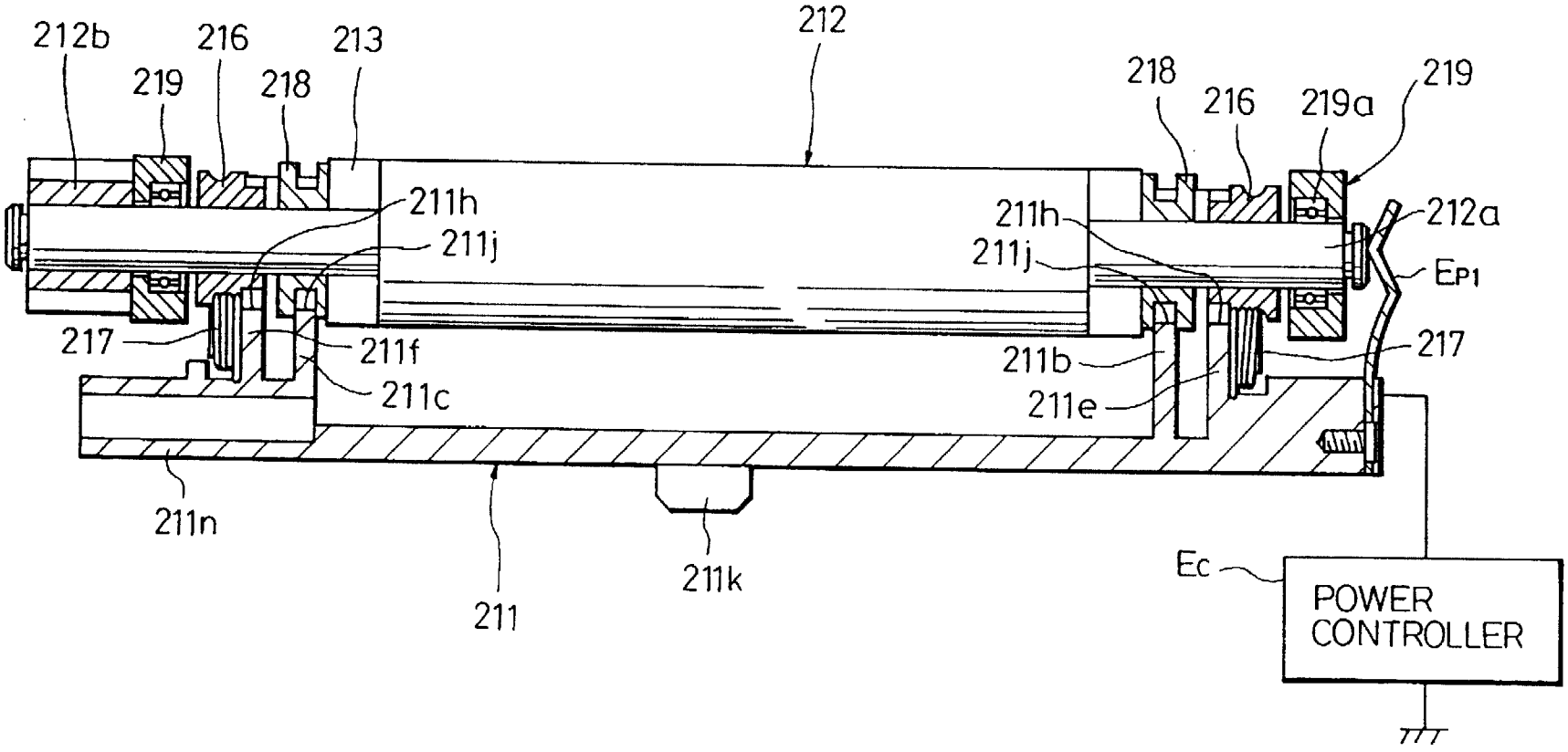
FIG. 3 is a sectional view of the developing means taken along the line III—III of FIG. 2.
Figure 5:
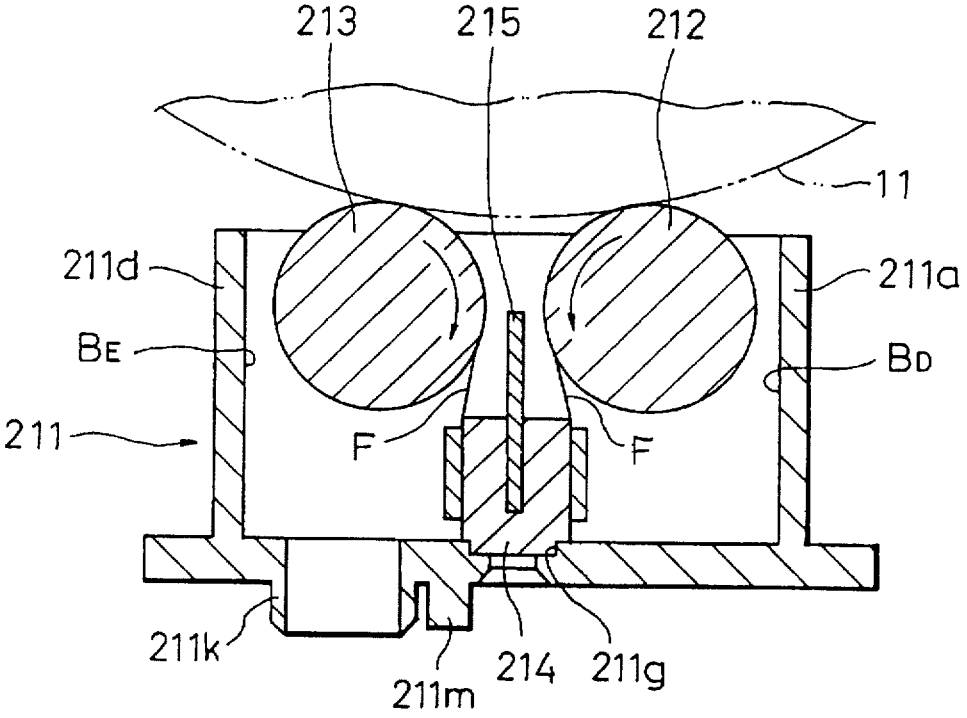
FIG. 5 is a sectional view of the developing means taken along the line V—V of FIG. 2.

In the first developing unit 21, as shown in FIGS. 2, 3, and 5, the liquid tank 211 is divided into two compartments, a developing tank $B_D$ and a discharge tank $B_E$. The developing roller 212 is located in the developing tank $B_D$, which is defined by a supporting member 214 longitudinally extending in the center, a partition 215 set up on the supporting member 214, and side walls 211*a*, 211*b*, and 211*c*. The squeeze roller 213 is located in the discharge tank $B_E$, which is defined by the side wall 211*a* and side walls 211*d*, 211*e*, and 211*f*.

As shown in FIG. 5, the supporting member 214 is fixed to a recess 211*g*, which is formed in the bottom wall of the liquid tank 211, and is provided with a plurality of small holes (not shown) which open into the discharge tank $B_E$. Further, the supporting member 214 is fitted, on the opposite side faces thereof, with plastic films F which are arranged so that their respective upper ends abut against their corresponding rollers 212 and 213, thereby scraping off the wet toner from the rollers. The films F may alternatively be metallic. The wet toner from the developing tank $B_D$, having overflowed the partition 215, flows into the discharge tank $B_E$ through the small holes in the supporting member 214.

Figure 4:
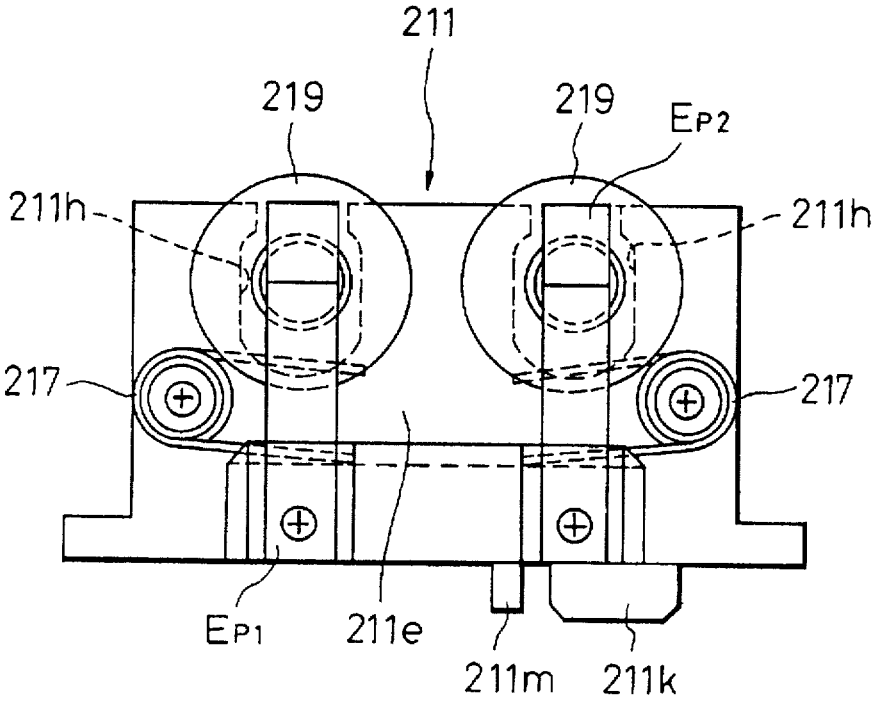
FIG. 4 is a right-hand side view of the developing means of FIG. 2.

As shown in FIGS. 2 to 4, each of the side walls 211*e* and 211*f* has narrow-topped slits 211*h*, and bearings 216 are attached to the respective slits 211*h*. The bearings 216, which individually support rotating shafts 212*a* and 213*a* of their corresponding rollers 212 and 213, are held in the slits 211*h* so as to allow slight up-and-down motion. A torsion coil spring 217 is interposed between each bearing 216 and the liquid tank 211, whereby each bearing 216 is urged upward. Since the top portion of each slit 211*h* is narrowed, the bearing 216 is prevented from being disengaged.

On the other hand, as shown in FIGS. 2 and 3, the side walls 211*b* and 211*c* have slits 211*j* with the same width, and bearings 218 are attached to the respective slits 211*j* so as to allow up-and-down motion. The bearings 218 support the rotating shaft 212*a* of the developing roller 212 in a liquid-tight manner lest the wet toner flow from the developing tank $B_D$ toward the discharge tank $B_E$.

In the liquid tank 211, as shown in FIGS. 3 to 5, a discharge port 211*k* through which the wet toner is discharged into the toner cartridge 26 protrudes downward from the bottom wall of the discharge tank $B_E$. Further, an inlet port 211*n* for the wet toner supplied from the toner cartridge 26 is provided just under that portion of the rotating shaft 212*a* which is situated on the one side wall 211*f* of the developing roller 212.

As shown in FIGS. 2 and 3, a spacer roller 219 is mounted on each end of each of the respective rotating shafts 212*a* and 213*a* of the developing roller 212 and the squeeze roller 213. Also, gears 212*b* and 213*b* are mounted on one end of the shafts 212*a* and 213*a*, respectively.

The spacer rollers 219 support the rotating shafts 212*a* and 213*a* of the rollers 212 and 213 with the aid of bearings 219*a*, individually. The outside diameter of the rollers 219 is a little larger than that of the rollers 212 and 213. Thus, when the spacer rollers 219 are in sliding contact with their corresponding ends of the photosensitive drum 11, a predetermined gap is formed between the drum 11 and each of the rollers 212 and 213. In the electrophotographic printer 1 of the present embodiment, the gap between the drum 11 and the developing roller 212 is adjusted to 100 μm, and the gap between the drum 11 and the squeeze roller 213 to 50 μm, for example.

As shown in FIGS. 2 to 4, the respective upper ends of electrode plates $E_{P1}$ and $E_{P2}$ are pressed against those end faces of the rotating shafts 212*a* and 213*a* of the rollers 212 and 213 on the side of the side wall 211*e*, respectively, while the respective lower ends of the electrode plates $E_{P1}$ and $E_{P2}$ are connected to a power controller $E_C$ for voltage supply.

Figure 6:
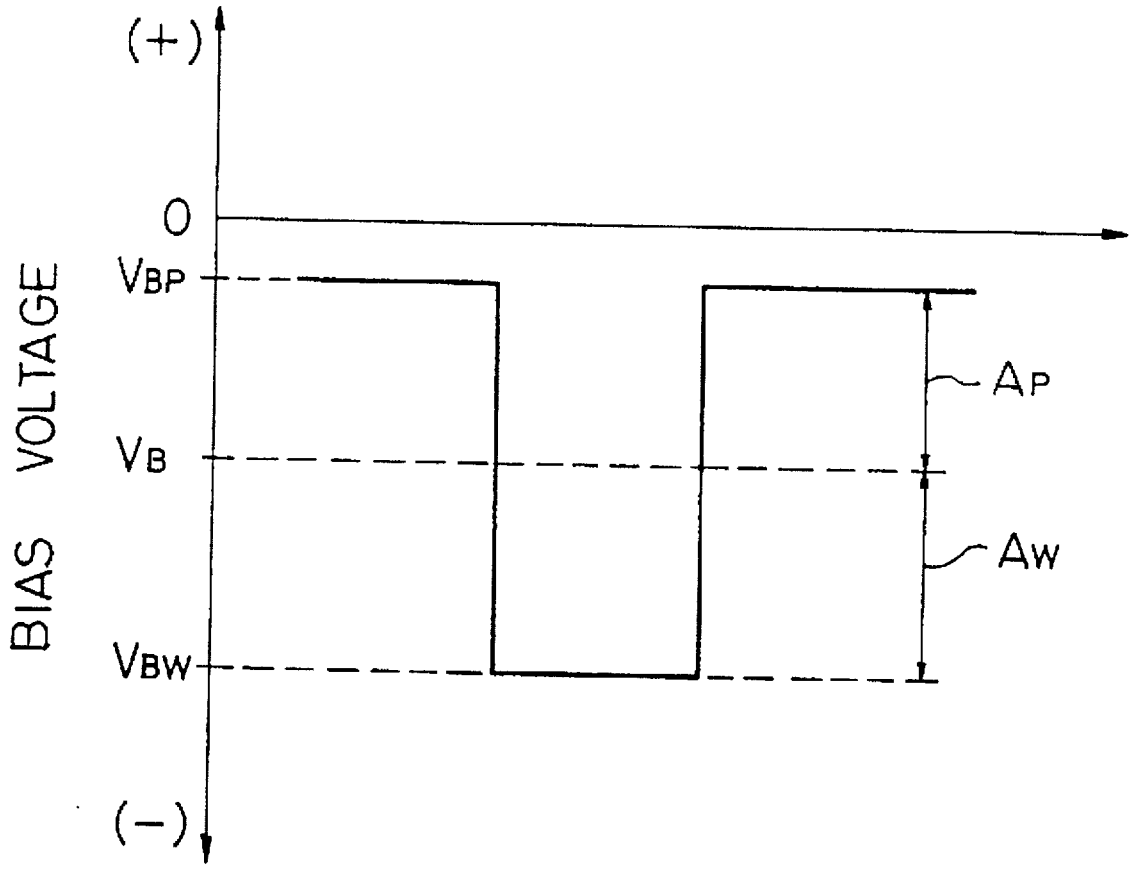
FIG. 6 is a view illustrating the surface potential of a photosensitive drum.

The one electrode plate $E_{P1}$ applies a developing bias voltage to the developing roller 212. In changing the developing units for developing the electrostatic latent images on the photosensitive drum 11, the bias voltage is increased from the white-ground area side to the print area side. Normally, as shown in FIG. 6, a developing bias voltage $V_B$ (about −300 to −500 V) is applied to the developing roller 212 so that a photosensitive drum surface potential $V_{BW}$ for a white-ground area $A_W$ ranges from about −500 to −700 V, and a photosensitive drum surface potential $V_{BP}$ for a print area $A_P$ is about −100 V. In changing the developing units, the bias voltage applied to the developing roller 212 is positively increased from the white-ground area side to the print area side. As a result, the surplus wet toner is removed from the surface of the photosensitive drum 11, so that the squeezing performance against the wet toner is improved. Thus, the surplus wet toner, especially the liquid carrier, can be prevented from adhering to the intermediate transfer drum 31.

Figure 7:
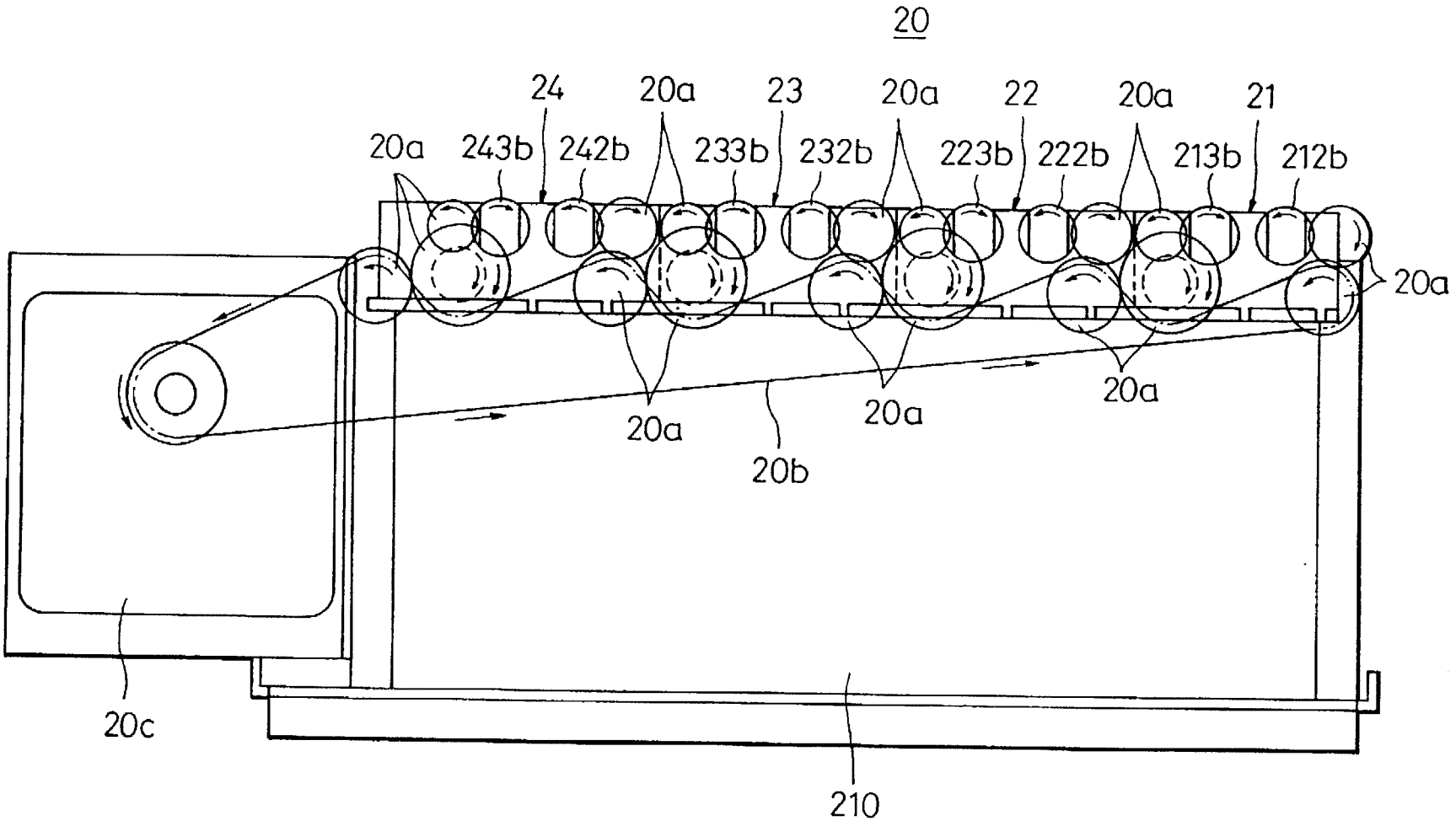
FIG. 7 is a rear view of the electrophotographic printer shown in FIG. 1.

As shown in FIG. 7, the rotation of a drive motor 20*c* is transmitted to the gears 212*b* and 213*b* mounted on their corresponding rollers 212 and 213, along with gears on the other developing units 22 to 24 on the rear side of the electrophotographic printer 1, by means of a timing belt 20*b* which is passed around a plurality of transmission members 20*a* each formed of an intermediate gear or timing pulley. Thus, in the developing units 21 to 24, the developing roller 212 is rotated in the same direction as the photosensitive drum 11 in the direction of a peripheral speed, while the squeeze roller 213 is rotated in the direction opposite to the rotating direction of the photosensitive drum 11 in the direction of a peripheral speed, as indicated by the arrows in FIG. 5.

By adjusting the number of teeth of each transmission member 20*a*, the respective peripheral speeds of the developing rollers and the squeeze rollers of developing units 21 to 24 are set so as to be, for example, equal to and 2.5 times as high as that of the photosensitive drum 11, respectively. If the peripheral speed of each roller is set in this manner, supplying the wet toners to the photosensitive drum 11 and squeezing the wet toners on the drum 11 are well-balanced, so that the electrostatic latent images can be developed under optimum conditions.

The squeeze rollers 213 to 243 of the developing units 21 to 24 are set so that the contact angle at which the liquid carrier of wet toner is in contact with the roller surface is smaller than the contact angle with respect to the surface of the photosensitive drum 11. Thus, the squeeze rollers 213 to 243 can remove surplus wet toner on the photosensitive drum 11 more efficiently. The mechanism etc. thereof will be described in detail later with the description of the auxiliary squeeze roller 60.

Thus, in the first developing unit 21, the electrostatic latent image formed on the photosensitive drum 11 is developed with use of the wet toner supplied to the drum 11 by means of the developing roller 212, the surplus wet toner adhering to the drum 11 is squeezed by means of the squeeze roller 213, and the developed toner image is transferred to the intermediate transfer drum 31. The same processes are executed for the other developing units 22 to 24. Meanwhile, the wet toner fed from the toner cartridge 26 is supplied to the developing tank $B_D$ through the inlet port 211*n* of the liquid tank 211. The wet toner overflowing the partition 215 and the wet toner flowing down along that film sheet F which abuts against the squeeze roller 213 flow into the discharge tank $B_E$ through the small holes in the supporting member 214, then flow back to the toner cartridge 26 through the discharge port 211*k*.

Figure 8:
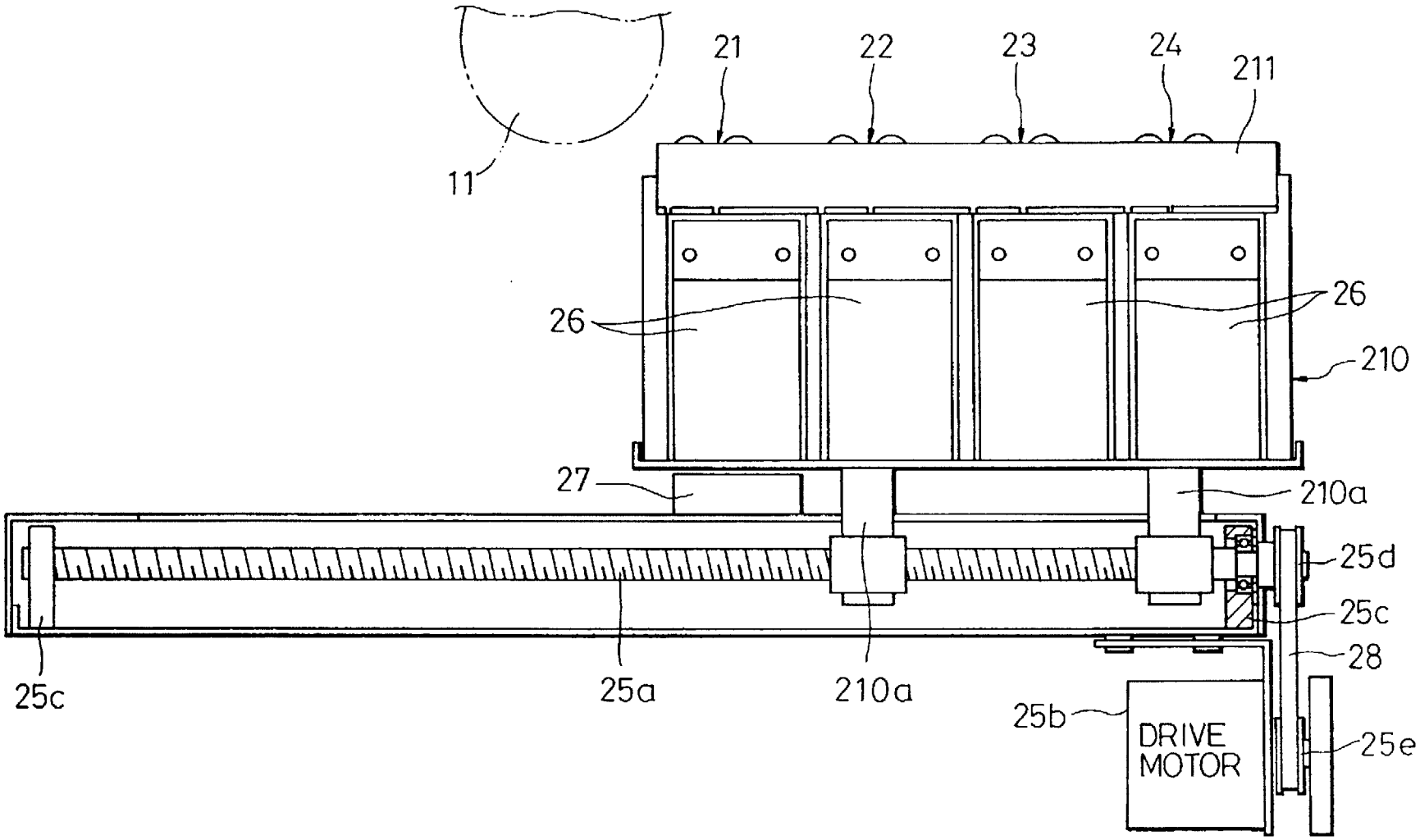
FIG. 8 is a front view showing drive means for integrally moving developing units of the electrophotographic printer of FIG. 1.

Referring now to FIG. 8, the drive means 25 for moving the developing units 21 to 24 in a body from side to side will be described. The drive means 25 includes the ball screw 25*a* and the drive motor 25*b* for rotating the screw 25*a*. The ball screw 25*a* is rotatably supported, at both ends thereof, on a pair of supporting brackets 25*c*, and is screwed in a plurality of supporting members 210*a* which, arranged at the lower portion of the housing 210, serve also as nuts. The ball screw 25*a* is rotated by means of a belt 28, which is passed around and between a pulley 25*d* on one end of the screw 25*a* and a pulley 25*e* of the drive motor 25*b*. Thus, the developing units 21 to 24 of the developing means 20 are moved in a body from side to side.

When the developing units 21 to 24 are moved to the left of FIG. 8, the first developing unit 21 first comes into contact with the photosensitive drum 11. In this state, as shown in FIGS. 2 to 4, the developing roller 212 and the squeeze roller 213 are supported by their corresponding bearings 216, which are held in the slits 211*h* of the liquid tank 211 so as to allow slight up-and-down motion, the bearings 216 are urged upward by the torsion coil spring 217, individually, and the spacer rollers 219 are mounted on their corresponding rotating shafts 212*a* and 213*a*.

Thus, the spacer rollers 219 on the rotating shaft 212*a* of the developing roller 212, for example, first come into sliding contact with their corresponding ends of the photosensitive drum 11. When the first developing unit 21 further moves to the left from this position, a downward force of pressure acts on the developing roller 212 through the medium of the spacer rollers 219.

Thereupon, the bearings 216, which support the rotating shaft 212*a* of the developing roller 212, moves slightly downward in their corresponding slits 211*h*, whereby the developing roller 212 dodges the photosensitive drum 11 so that the predetermined gap is secured between the roller 212 and the drum 11 by the spacer rollers 219. In this manner, the first developing unit 21 is moved to a developing position such that the photosensitive drum 11 is situated between the developing roller 212 and the squeeze roller 213.

When replacing one developing unit with another, the rotation of each developing roller is stopped, and the developing units 21 to 24 are then moved together to the left by the drive means 25. More specifically, when the developing unit 21, having developed the electrostatic latent image on the photosensitive drum 11, is replaced with the next developing unit 22, the developing roller 212 stops, and no wet toner is supplied to the drum 11. Thus, the photosensitive drum 11 cannot be supplied with any excessive wet toners. Besides the wet toner squeezing effect of the squeeze roller 213 which approaches following the developing roller 212, therefore, the above effect prevents surplus wet toners from adhering to the photosensitive drum 11, and the squeezing performance to remove the wet toners from the drum 11 is further improved. Thus, no surplus wet toners adhere to the intermediate transfer drum 31, and no wet toners enter into the adjacent developing units, so that the wet toners cannot be soiled by one another.

In the developing means 20 constructed in this manner, all the developing units 21 to 24 can be changed or restored to their initial position by only being moved in one horizontal direction. Accordingly, the developing means 20 need not undergo a complicated motion such that all the developing units are also moved in the vertical direction to dodge the photosensitive drum 11, so that the construction of the drive means 25 can be simplified.

Figure 9:
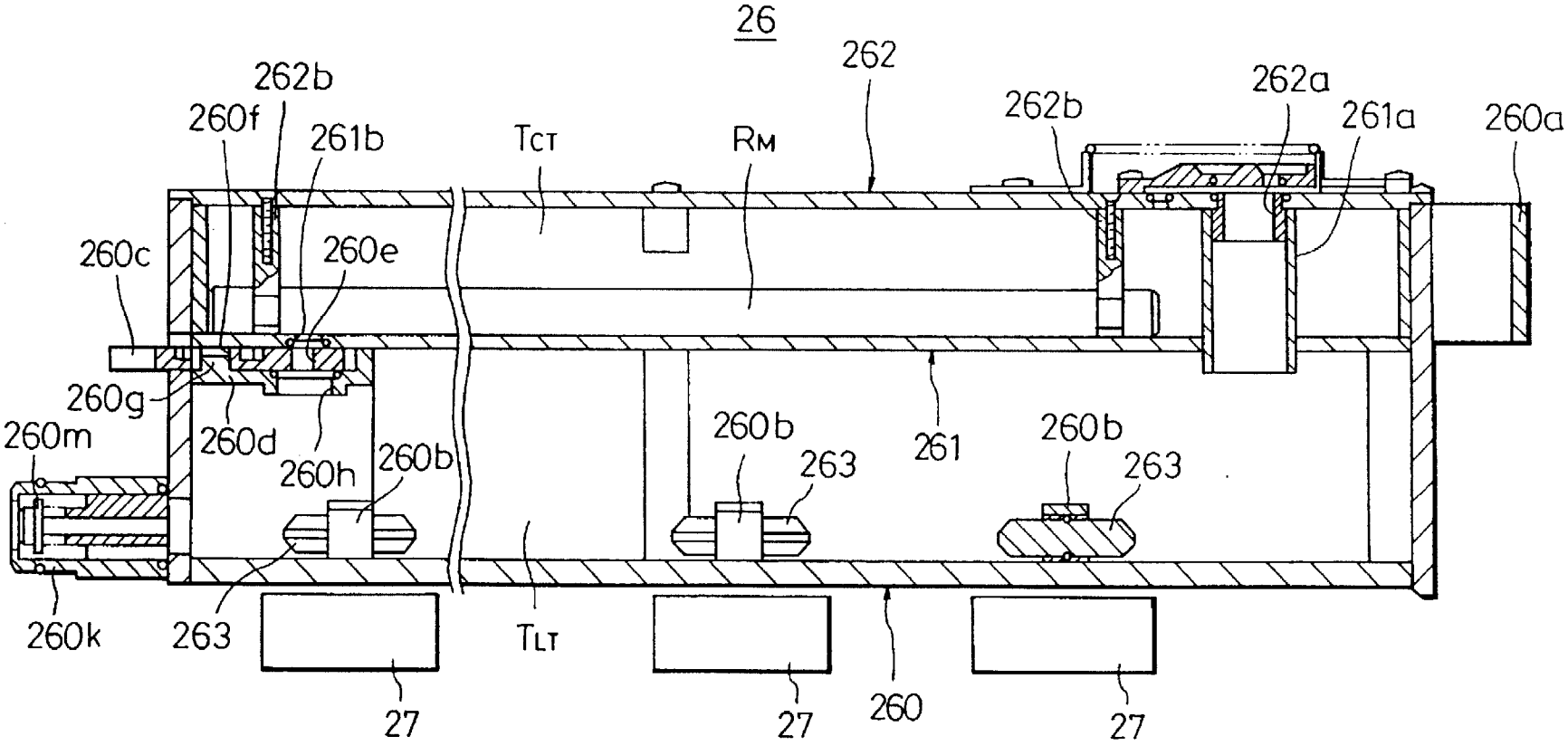
FIG. 9 is a front sectional view showing a toner cartridge of one of the developing units.
Figure 10:
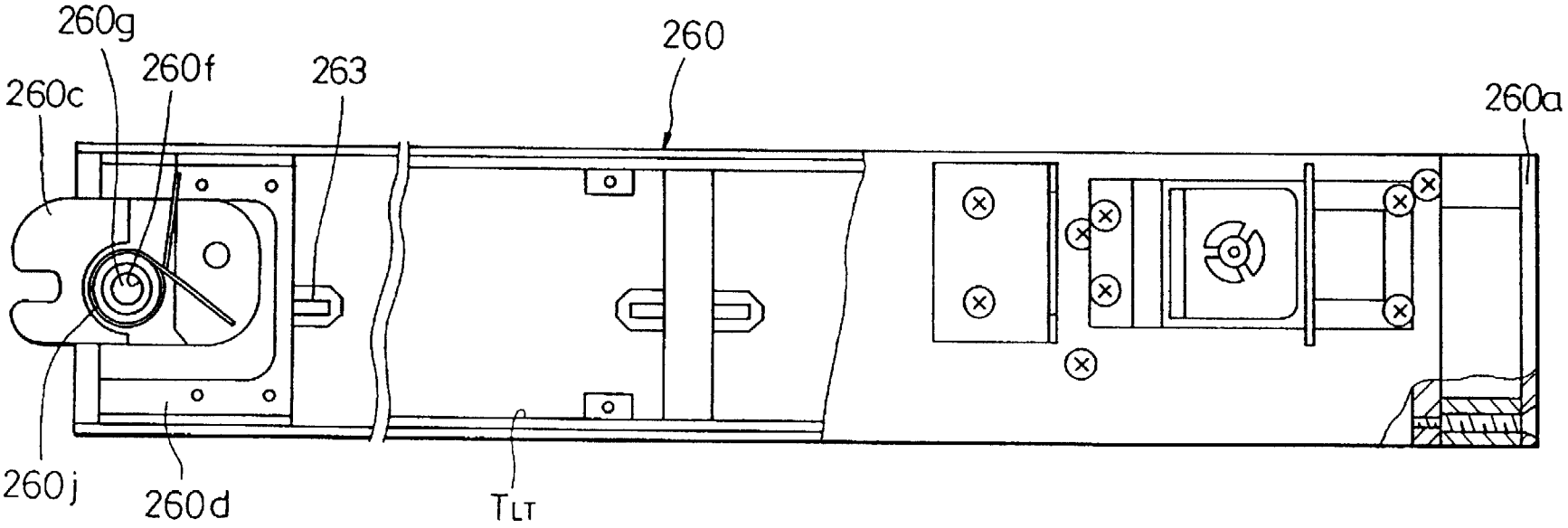
FIG. 10 is a partially cutaway plan view of a toner cartridge.
Figure 11:
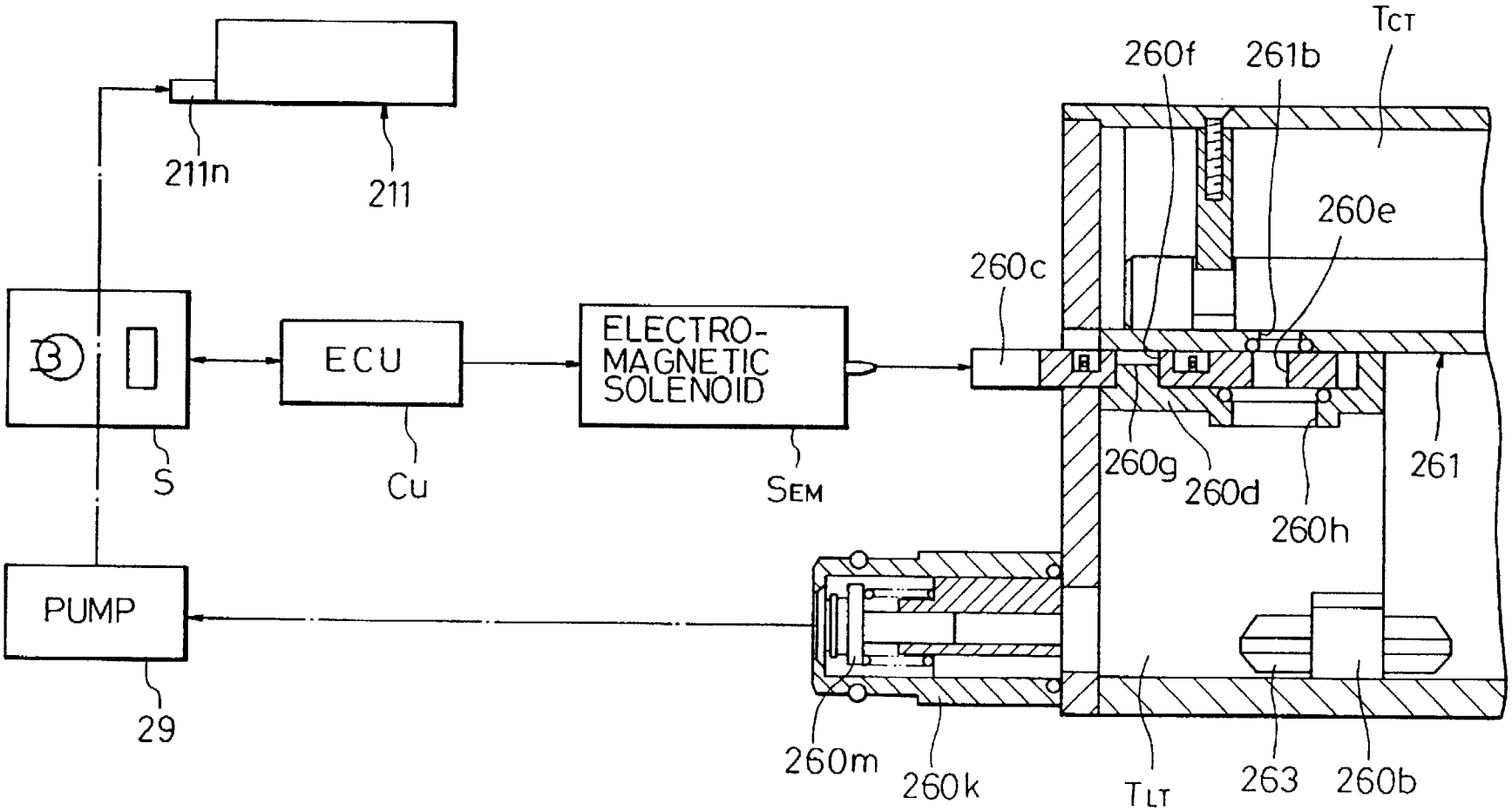
FIG. 11 is a block diagram showing a mechanism for adjusting the concentration of wet toner fed from each toner cartridge to its corresponding developing unit.

Referring now to FIGS. 9 to 11, the toner cartridge 26 will be described. The toner cartridge 26 is a disposable cartridge which is removably attached to the housing of each developing unit. The cartridge 26 includes a rectangular casing 260, a partition wall 261 vertically dividing the casing 260, and a cover plate 262. A concentrated toner tank $T_{CT}$ for containing a concentrated toner is defined in the upper portion of the cartridge 26, and a wet toner tank $T_{LT}$ for containing a developing wet toner in the lower portion.

The casing 260 has a grip 260*a* on its front face. Arranged at the bottom of the casing 260 are three supporting members 260*b* for individually supporting magnetic rotors 263 for rotation. Each magnetic rotor 263 is rotated by each corresponding one of drive units 27 which are arranged facing the housing 210. The drive units 27 generate rotating magnetic fields when supplied with AC current, thereby rotating their corresponding magnetic rotors 263 to stir the wet toner in the wet toner tank $T_{LT}$.

At the lower part of the partition wall 261 of the casing 260 on the rear wall side, a closing plate 260*c* is supported by a supporting plate 260*d*. The closing plate 260*c* has a through hole 260*e* and an engaging hole 260*f*, while the supporting plate 260*d* has a protrusion 260*g* and an outlet port 260*h*. The closing plate 260*c* is turned around the protrusion 260*g* disposed on the supporting plate 260*d*, by engaging the engaging hole 260*f* with the protrusion 260*g*. The closing plate 260*c* is normally urged toward the closed position shown in FIG. 10 by a spring 260*j* so that the communication between the through hole 260*e* and the outlet port 260h is interrupted. At the lower part of the casing 260 under the closing plate 260c, a feed port 260k is provided to feed wet toners to the upper tank (211, 221, 231 and 241). The feed port 260k is provided with a valve 260m and a spring. The valve 260m is closed by the spring, thereby the feed port 260k being closed. When the toner cartridge 26 is attached to the housing of each developing unit, the feed port 260k is connected to a socket (not shown) formed in the housing, and the valve 260m is opened resisting the urging force of the spring. Thereupon, the wet toner is discharged through the port 260k into a pump 29, which will be mentioned later.

The partition wall 261 has a cylindrical receiving portion 261a, which extends in the vertical direction and communicates with the wet toner tank $T_{LT}$, on the front wall side. An outlet port 261b is provided at the position corresponding to the outlet port 260h of the supporting plate 260d.

The cover plate 262 has a returning cylinder 262a, which fits into the receiving portion 261a, on the front wall side. The returning cylinder 262a communicates with a discharge port 211k of the liquid tank 211 when the toner cartridge 26 is attached to the housing 210. The cover plate 262 has guide plates 262b on the lower surface on the concentrated toner tank $T_{CT}$, with a gap being provided between the guide plate 262b and the partition wall 261. The guide plates 262b serve to guide the rolling of an agitating roller $R_M$ provided by use of the gap between the guide plate 262b and the partition wall 261. As the developing means 20 is moved for the change of developing units 21 to 24, the agitating roller $R_M$ is rolled on the bottom of the concentrated toner tank $T_{CT}$ by the inertia, so that concentrated toner therein is stirred.

The wet toners are supplied from the individual toner cartridges 26 to their corresponding developing units only when the electrophotographic printer 1 is to be used or operated. Normally, the liquid tanks of developing units contain no wet toners. The magnetic rotors 263, which are rotated by means of their corresponding drive units 27 when the printer 1 is connected to the power supply to be energized, for example, serve to stir the wet toners, thereby uniformly dispersing the deposited toner particles in the liquid carrier.

Thus, in the toner cartridge 26 set in position in the housing 210, as shown in FIG. 11, the wet toner in the wet toner tank $T_{LT}$ is delivered through the feed port 260k to the developing unit 21 above by means of the pump 29, and is then fed through the inlet port 211n into the liquid tank 211. The wet toner, having its concentration lowered after developing in the developing unit 21, flows back to the wet toner tank $T_{LT}$ via the discharge port 211k of the liquid tank 211 and the returning cylinder 262a.

In the meantime, the concentration of the wet toner fed into the liquid tank 211 is detected by a concentration sensor S arranged between the pump 29 and the liquid tank 211. If the concentration is low, a command signal is delivered from a control unit (ECU) $C_U$. In response to this command signal, the electromagnetic solenoid $S_{EM}$ is energized for a short period of time, and is activated Go press the closing plate 260c on the toner cartridge 26 in the opening direction resisting the urging force of the spring 260j.

Thereupon, the closing plate 260c is turned around the protrusion 260g of the supporting plate 260d so that the through hole 260e coincides with the outlet port 261b in the partition wall 261 and the outlet port 260h in the supporting plate 260d. As a result, the highly concentrated toner in the concentrated toner tank $T_{CT}$ flows out of the outlet port 260h into the wet toner tank $T_{LT}$, so that the concentration of the wet toner supplied to the developing unit 21 increases. This supply of the concentrated toner is repeated so that the concentration of the wet toner supplied to the developing unit 21 increases to a predetermined value.

At this time, the highly concentrated toner in the concentrated toner tank $T_{CT}$ is stirred uniformly by the rolling of the agitating roller $R_M$ occurring along with the developing work. Therefore, the change of concentration of wet toner, which flows into the wet toner tank $T_{LT}$ and is supplied to the developing unit 21, is stabilized.

In this manner, a wet toner of a predetermined concentration is supplied from each toner cartridge 26 to its corresponding developing unit. When the concentrated toner in the concentrated toner tank $T_{CT}$ is used up, the toner cartridge 26 is drawn out of the housing 210 and abandoned, and a new toner cartridge 26 is attached instead.

The toner cartridge 26 can be a disposable unit because the drive units 27 are arranged on the housing 210, while the magnetic rollers 263 are located inside. Since the wet toner tank $T_{LT}$ and the concentrated toner tank $T_{CT}$ are formed integrally with each other, moreover, they need not be separately connected to the electrophotographic printer 1. Thus, the number of junctions between each toner cartridge 26 and the printer 1 can be lessened, so that the printer 1 can be simplified in construction, and its components can be reduced in number. The means for stirring the highly concentrated toner in the concentrated toner tank $T_{CT}$ is not limited to the aforementioned agitating roller $R_M$. The stirring means may be any means which is rolled on the bottom of the concentrated toner tank $T_{CT}$ by the inertia as the developing means 20 is moved for the change of the developing units 21 to 24, such as a pipe or a ceramic ball and other spherical members.

Figure 12:
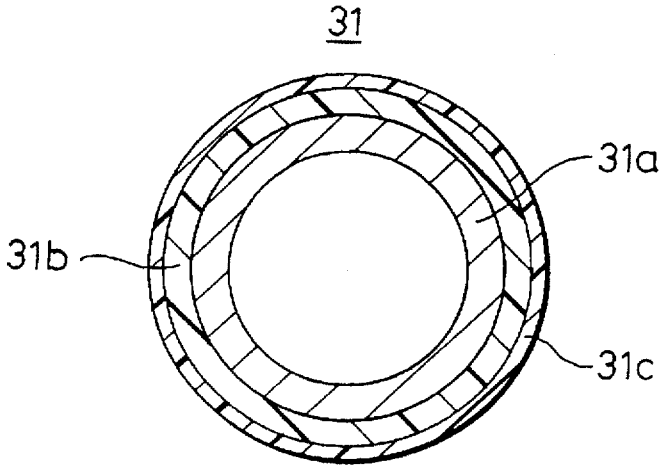
FIG. 12 is a sectional view showing the construction of an intermediate transfer drum.
Figure 13:
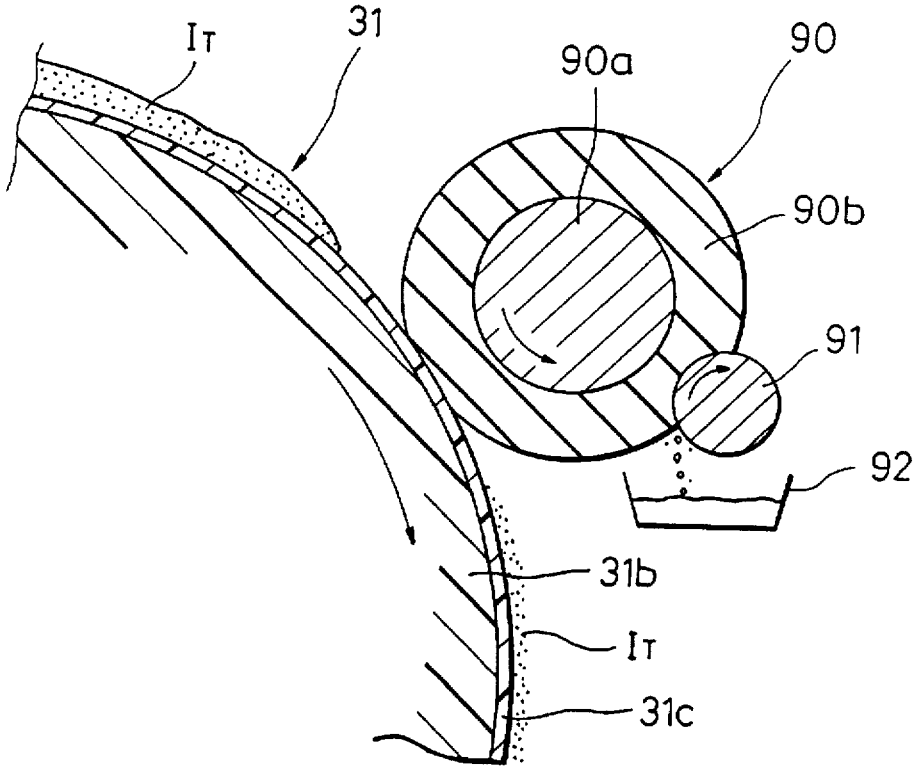
FIG. 13 is a sectional view showing the removal of surplus liquid by means of a liquid absorbing roller provided on the intermediate transfer drum.

The intermediate transfer drum 31 consists of a cylindrical metallic drum 31a on which a thin insulating silicone resin layer 31c is formed with a cushion layer 31b made of conductive rubber being interposed between the metallic drum 31a and the silicone resin layer 31c as shown in FIG. 12. If the surface of the intermediate transfer drum 31 has insulating properties, the transfer performance of toner image from the photosensitive drum 11 to the intermediate transfer drum 31 is improved.

When the intermediate transfer drum 31 is pressed in contact with the photosensitive drum 11, a high voltage must be applied to the photosensitive drum 11 in order to enhance the transfer performance of toner image. However, the voltage which can be applied has a limit value. If the surface of the intermediate transfer drum 31 is made of a conductive material, electric discharge occurs from the photosensitive drum 11 to the intermediate transfer drum 31 when the limit voltage is exceeded. If the surface of the intermediate transfer drum 31 has insulating properties, therefore, this electric discharge is inhibited, so that the voltage applied to the photosensitive drum 11 can be increased, resulting in an increase in transfer performance of toner image.

Further, a liquid absorbing roller 90, which absorbs and removes surplus liquid contained in the toner image transferred from the photosensitive drum 11, that is, the liquid carrier of wet toner, is provided on the intermediate transfer drum 31 on the downstream side of the contact portion where the drum 31 is pressed against the photosensitive drum 11, as shown in FIG. 1, to improve print quality.

The toner image transferred to the intermediate transfer drum 31, which has been developed on the photosensitive drum 11 by means of wet toner, contains surplus wet toner, particularly liquid carrier. Therefore, if the multicolor toner image formed on the intermediate transfer drum 31 is fixed, as it is, on a recording medium such as transfer paper which is nipped by a heating roll 51, image flow occurs easily due to the surplus liquid contained in the multicolor toner image, resulting in a degradation in the quality of fixed image.

For this reason, the liquid absorbing roller 90 is provided to absorb and remove this surplus liquid. The liquid absorbing roller 90, being a sponge roller consisting of a metallic roller 90*a* whose surface is coated with a sponge 90*b*, is rotatably contact with the intermediate transfer drum 31. A roller 91 for squeezing the liquid carrier absorbed by the sponge 90*b* is pressed against the liquid absorbing roller 90, so that the squeezed liquid carrier is recovered as waste liquid into a tray 92 disposed under the roller 91.

Thus, the liquid absorbing roller 90 absorbs surplus liquid carrier from the toner image $I_T$ on the intermediate transfer drum 31, which is transferred from the photosensitive drum 11, so that the toner image $I_T$ containing no surplus liquid carrier is fixed on the transfer paper P by means of the heating roll 51, by which image flow is prevented and the quantity of vaporized gas, resulting from the liquid carrier, discharged out of the electrophotographic printer 1 is kept small.

As the liquid absorbing means for absorbing and removing the surplus liquid from the toner image transferred to the intermediate transfer drum 31, an endless belt may be used instead of the aforementioned roller. The liquid absorbing roller 90 may use, for example, paper, cloth such as non-woven fabric, or a polymeric absorber as means for absorbing and removing surplus liquid instead of the sponge 90*b*.

The auxiliary squeeze roller 60 is set so that the contact angle at which the liquid carrier of wet toner is in contact with the surface of the auxiliary squeeze roller 60 is smaller than the contact angle at which it is in contact with the surface of the photosensitive drum 11. The removal of wet toner on the photosensitive drum 11 performed by the squeeze roller 213 will be described with reference to FIG. 14. On the photosensitive drum 11, which rotates in the arrow direction in FIG. 14, wet toner is applied on the surface thereof by the developing roller (not shown) to develop the toner image. The wet toner $L_T$ applied to the photosensitive drum 11 has a substantially uniform thickness by being removed by the squeeze roller 213 rotating in the same direction. The removed wet toner flows back into the developing tank (not shown) by being guided by the film F whose upper end abuts against the squeeze roller 213. Thus, the toner image on the photosensitive drum 11 is transferred to the intermediate transfer drum 31.

Figure 14:
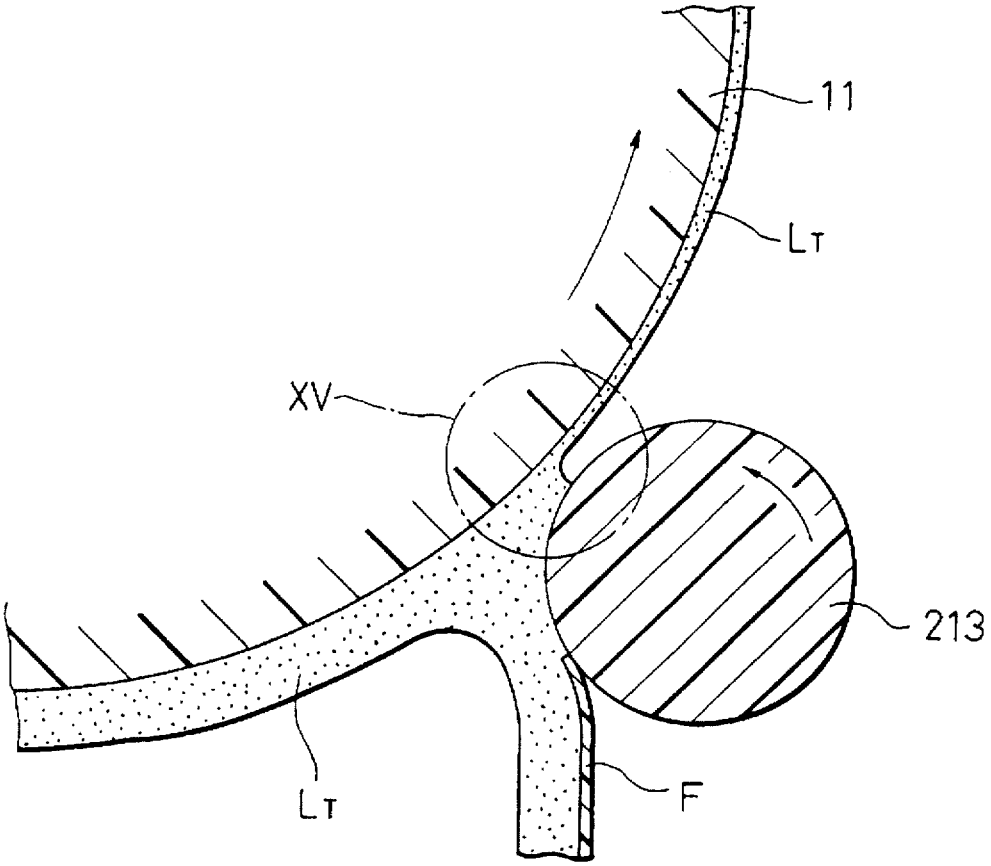
FIG. 14 is a sectional view showing the removal of surplus liquid by means of an auxiliary squeeze roller provided on the photosensitive drum.
Figure 15:
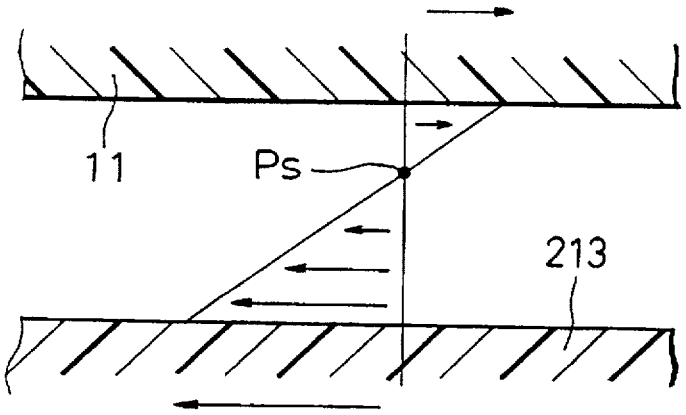
FIG. 15 is a sectional view showing a state such that wet toner is removed in the case where the surface tension of the photosensitive drum is equal to that of the squeeze roller.

The flow velocity distribution of wet toner $L_T$ at the XV portion in FIG. 14 where the squeeze roller 213 faces the photosensitive drum 11 turns to the right, which is the rotating direction of the photosensitive drum 11, on the photosensitive drum 11 side, while it turns inversely to the left on the squeeze roller 213 side as shown in FIG. 15, which is an expanded view of the XV portion. Therefore, the wet toner $L_T$ is sheared at position $P_S$ where the flow velocity is zero, and separated into the portion on the photosensitive drum 11 side and the portion on the squeeze roller 213 side.

If the contact angle at which the liquid carrier of wet toner is in contact with the surface of the auxiliary squeeze roller 60 is smaller than the contact angle at which it is in contact with the surface of the photosensitive drum 11, position $P_S$ where the flow velocity of the wet toner $L_T$ is zero comes to the photosensitive drum 11 side, while in the inverse case, position $P_S$ comes to the squeeze roller 213 side. If the contact angles are equal on the squeeze roller 213 side and on the photosensitive drum 11 side, position $P_S$ is in the middle.

If the contact angle at which the liquid carrier of wet toner is in contact with the surface of the auxiliary squeeze roller 60 is set so as to be smaller than the contact angle at which it is in contact with the surface of the photosensitive drum 11, therefore, position $P_S$ where the flow velocity is zero moves to the photosensitive drum 11 side as shown in FIG. 15, so that the quantity of the wet toner $L_T$ adhering to the squeeze roller 213 increases. As a result, the effect of removing surplus liquid, that is, the liquid carrier of the wet toner $L_T$ is enhanced. Also, since the wet toner $L_T$ becomes difficult to separate from the squeeze roller 213, the squeeze roller 213 can be rotated at a higher speed, so that the effect of removing surplus liquid is enhanced. This wet toner removing mechanism applies to the case of the photosensitive drum 11 and auxiliary squeeze roller 60.

In order to reduce the contact angle of the liquid carrier of the wet toner $L_T$ with respect to the squeeze roller 213 or the auxiliary squeeze roller 60 as compared with the contact angle with respect to the photosensitive drum 11, for example, polyester resin, polypropylene resin, polyurethane resin, etc. are used as a material forming the surface of the squeeze roller 213 or the auxiliary squeeze roller 60, and fluororesin, silicone resin, etc. are used as a material forming the surface of the photosensitive drum 11.

Figure 16:
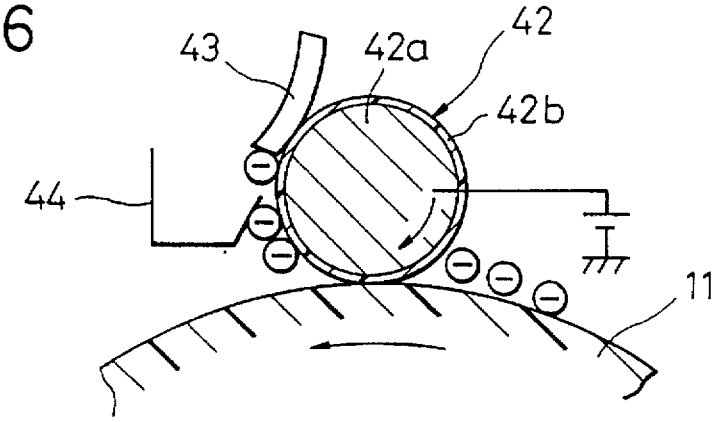
FIG. 16 is a sectional view showing the configuration of cleaning means of the electrophotographic printer.
Figure 17:
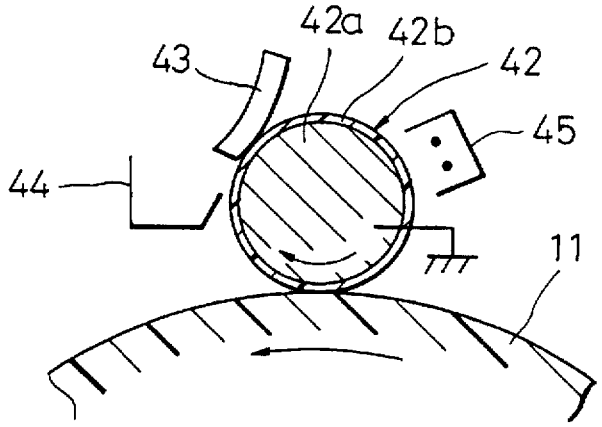
FIG. 17 is a sectional view showing another modification of the cleaning means.
Figure 18:
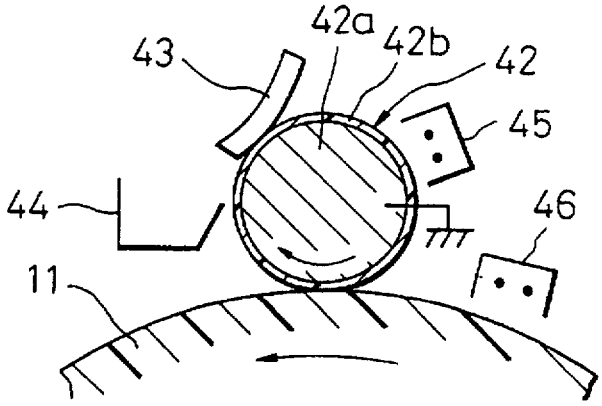
FIG. 18 is a sectional view showing still another modification of the cleaning means.

Referring now to FIGS. 16 to 18, the construction of the cleaning means 40 will be described further in detail.

The cleaning means 40 includes the cleaning roller 42 and a blade 43 whose tip end is pressed against the cleaning roller 42, which are arranged in the cartridge 41, as shown in FIG. 16.

The cleaning roller 42, which consists of an electrically conductive roller 42*a* made of aluminum whose surface is coated with an insulating layer 42*b* of polyester film, is rotated at a speed equal to the peripheral speed of the photosensitive drum 11 in the direction indicated by the arrow in the figure, the direction opposite to that of the photosensitive drum 11, by a driving means (not shown) disposed in the cartridge 41. To this cleaning roller 42 is applied a bias voltage which is opposite in polarity to the toner, by which the residue of toner image remaining on the photosensitive drum 11 without being transferred to the intermediate transfer drum 31 is adsorbed electrostatically.

The blade 43 is an urethane rubber blade for scraping off the residue of toner image adsorbed electrostatically by the cleaning roller 42 into a recovery container 44 installed under the blade 43.

Thus, in the cleaning means 40, the residue of toner image remaining on the photosensitive drum 11 without being transferred to the intermediate transfer drum 31 is effectively cleaned by being adsorbed electrostatically. In addition, the life of the photosensitive drum 11 increases as compared with the case where physical cleaning is performed by pressing a cleaning blade etc. against the photosensitive drum 11, the rotation of the photosensitive drum 11 becomes smooth, and the chattering vibration due to the pressing of the blade does not occur, thereby the print quality obtained by the electrophotographic printer 1 being improved.

As shown in FIG. 17, the cleaning means 40 is equipped with a charger 45, which charges the cleaning roller 42 to the polarity opposite to that of toner, on the upstream side of the pressing portion, where the cleaning roller 42 is pressed against the photosensitive drum 11, with respect to the rotating direction of the cleaning roller 42, or as shown in FIG. 18, in addition to the charger 45, the photosensitive drum 11 is equipped with a charger 46, which controls the surface potential of the photosensitive drum 11, on the upstream side of the aforementioned pressing portion to provide the same effect.

As the potential control means provided on the photosensitive drum 11, a discharge lamp may be used. If the cleaning roller 42 is provided with a cushion layer between the conductive roller 42*a* and the insulating layer 42*b*, an excessive pressing force does not act on the photosensitive drum 11, the life of the photosensitive drum 11 further increases, and contact between the cleaning roller 42 and the photosensitive drum 11 can be enhanced.

Figure 19:
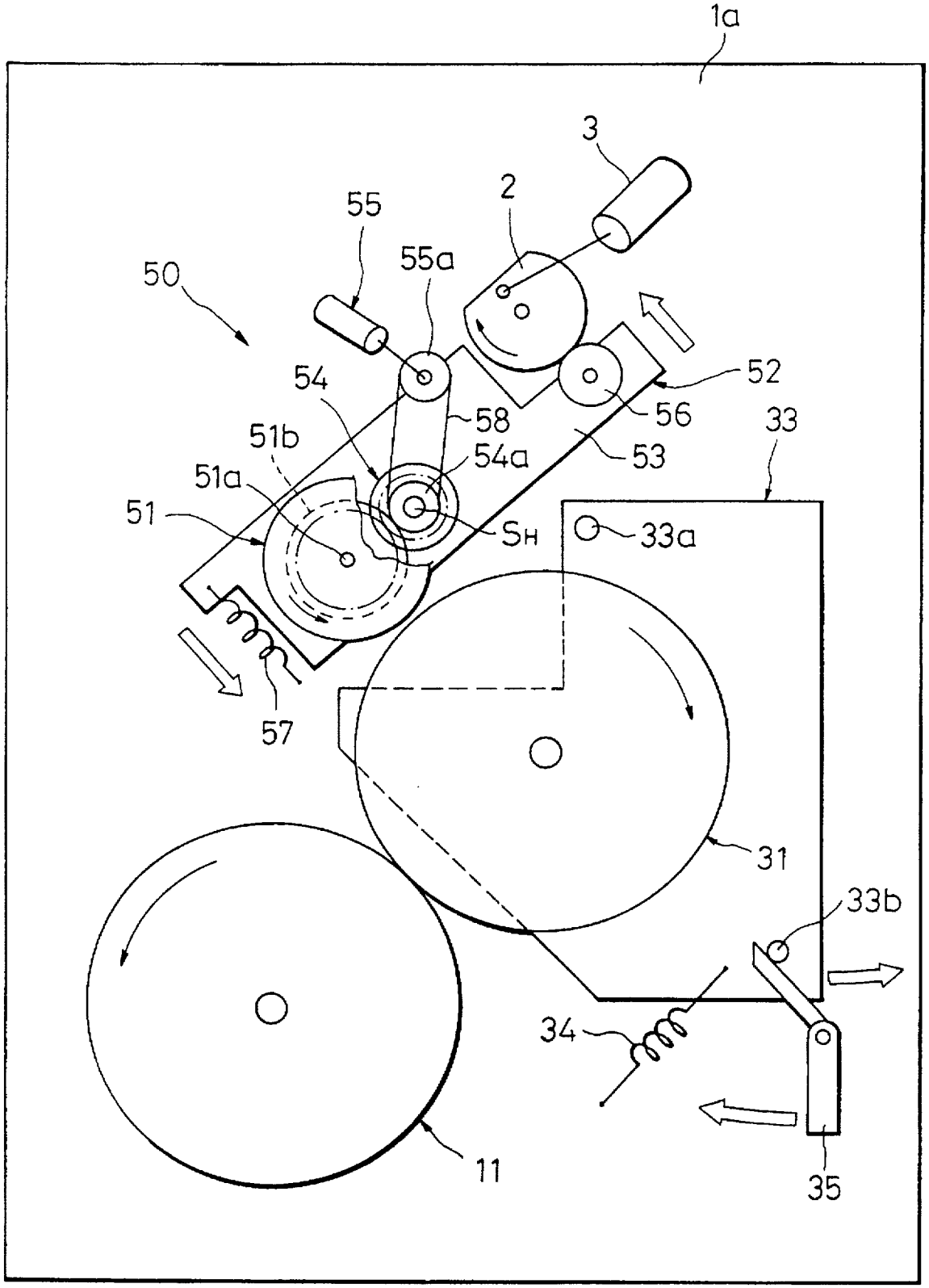
FIG. 19 is a general view showing a push mechanism for transfer means in a state such that a heating roll is kept apart from the intermediate transfer drum.
Figure 20:
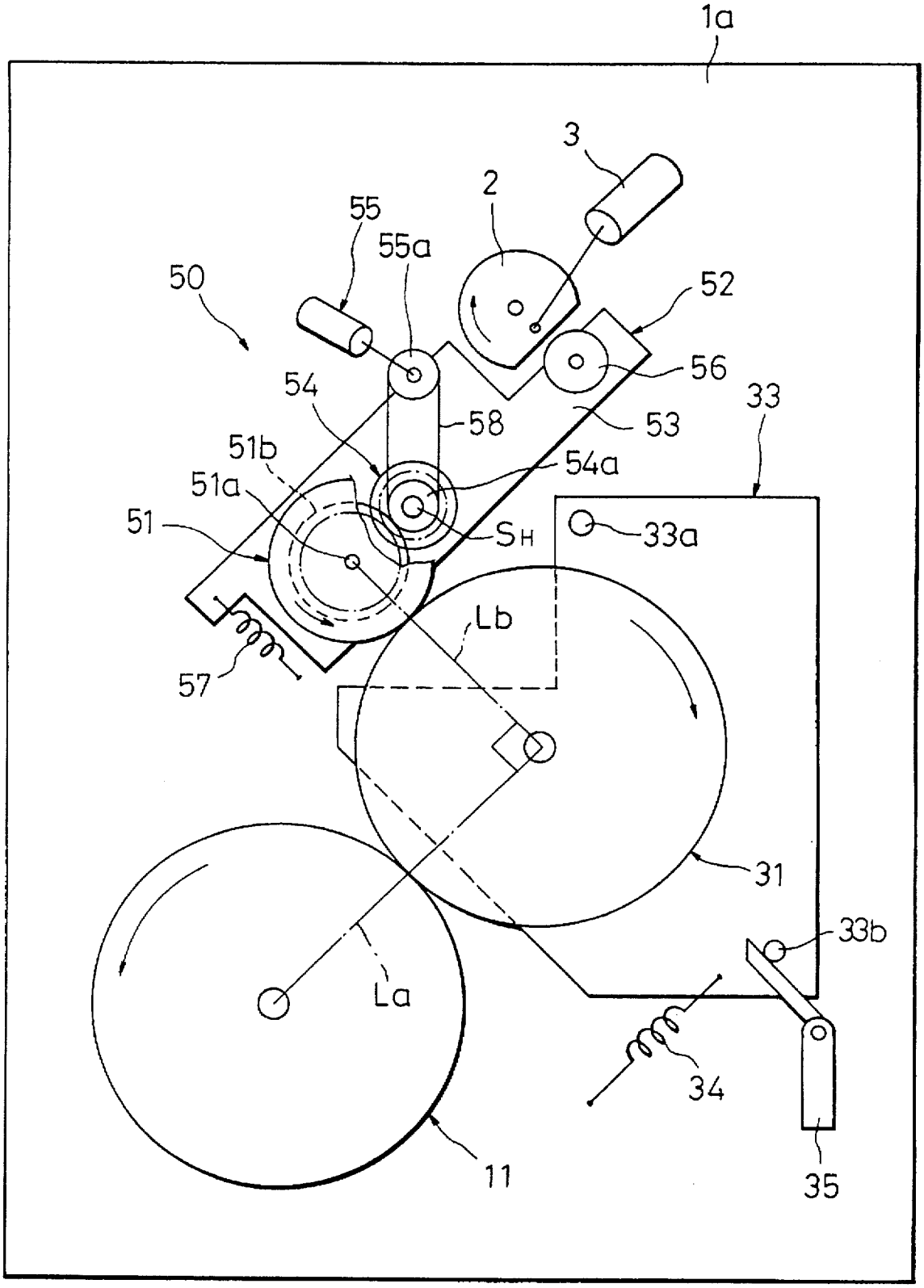
FIG. 20 is a general view showing a state such that the heating roll is pressed against the intermediate transfer drum.

Referring now to FIGS. 19 and 20, the push mechanism 52 of the transfer means 50 will be described. The push mechanism 52 includes the heating roll 51, a gear 54, a drive motor 55, a bearing 56, etc., supported on a supporting base 53 which is mounted on a body 1*a* of the electrophotographic printer 1 for rocking motion with respect to the intermediate transfer drum 31.

The heating roll 51, which is supported on one side of the supporting base 53, is pressed against the intermediate transfer drum 31 as the base 53 rocks. A substantially central portion of the base 53 is supported diagonally above the drum 31 for rocking motion by means of a shaft $S_H$. The supporting base 53 is urged toward the intermediate transfer drum 31 by a spring 57, one end of which is anchored to the printer body 1*a*, and the other end to the one side of the base 53. The gear 54, along with a pulley 54*a* integral therewith, is rotatably supported by the shaft $S_H$, and is in mesh with a gear 51*b* which is mounted on one end of a shaft 51*a* of the heating roll 51. The drive motor 55 causes the heating roll 51 to be rotated by means of a belt 58 which is passed around and between a pulley 55*a* fixed to the rotating shaft of the motor 55 and the pulley 54*a* of the gear 54. The bearing 56, which is pivotally supported on the other side of the supporting base 53, is pressed by an eccentric cam 2, which is mounted on the printer body 1*a*, so that the base 53 is rocked in the clockwise direction around the shaft $S_H$, thereby separating the heating roll 51 from the intermediate transfer drum 31. The eccentric cam 2 is turned by a drive motor 3 on the printer body side with the aid of a gear system (not shown).

The push mechanism 52 constructed in this manner operates as follows. While the toner images are being successively transferred to the intermediate transfer drum 31 after the electrostatic latent images on the photosensitive drum 11 are developed by the developing units 21 to 24, the eccentric cam 2 presses the bearing 56, thereby keeping the heating roll 51 apart from the intermediate transfer drum 31, as shown in FIG. 19. At this time, the supporting base 53 is subjected to the force of the spring 57 to urge it counterclockwise around the spring $S_H$, as indicated by the arrow of FIG. 19. When the transfer of the last toner image to the intermediate transfer drum 31 is started, the drive motor 3 starts to rotate, thereby disengaging the eccentric cam 2 from the bearing 56.

Thereupon, the heating roll 51, supported on the supporting base 53, is pressed against the intermediate transfer drum 31 by means of the urging force of the spring 57, as shown in FIG. 20, and the transfer paper P is nipped between the drum 31 and the roll 51 as the last toner image is transferred to the surface of the drum 31. As a result, the toner images in the four colors, transferred in layers to the intermediate transfer drum 31, are heated under pressure and fixed on the transfer paper P, whereupon the color print is formed.

The intermediate transfer drum 31 is rotatably supported substantially on the center of a supporting plate 33, the upper end of which is rockably mounted on the printer body 1*a* by means of a supporting shaft 33*a*. The drum 31 is pressed against the photosensitive drum 11 with a predetermined force of pressure by means of the urging force of a spring 34, one end of which is anchored to the body 1*a*, and the other end to the lower end of the supporting plate 33. The intermediate transfer drum 31 touches and leaves the photosensitive drum 11 as a release lever 35, which is in engagement with a stopper pin 33*b* on the lower portion of the supporting plate 33, is turned.

As shown in FIG. 20, if a line $L_a$, which passes through the centers of rotating shafts of the photosensitive drum 11 and the intermediate transfer drum 31 is substantially perpendicular to a line $L_b$, which passes through the centers of rotating shafts of the intermediate transfer drum 31 and the heating roll 51, when the heating roll 51 is pressed against the intermediate transfer drum 31, the component force in the line $L_a$ direction of a pressing force acting in the line $L_b$ direction becomes zero. Therefore, the pressing of the heating roll 51 does not cause a stress, which changes the pressing force of the intermediate transfer drum 31 pressed against the photosensitive drum 11, to act on the intermediate transfer drum 31. For this reason, the intermediate transfer drum 31 is pressed against the photosensitive drum 11 always with a constant pressing force, so that the transfer of toner images developed on the photosensitive drum 11 to the intermediate transfer drum 31 has no detrimental effect.

It is to be understood that the electrophotographic printer 1 of the present invention may be used as a color copying machine, provided the print information is given in the form of reflected light from color original documents, and that the printer can produce single-color prints as well as color prints.

Although the wet electrophotographic printer using wet toner is described in the above embodiment, the present invention may also be applied to the dry electrophotographic printer using dry toner.

Further, although paper is used as the recording medium according to the embodiment described herein, the images may also be transferred to various other recording media, such as PPC or other plastic films, metallic sheets, and cans.

As seen from the above description, the present invention provides an electrophotographic printer and an electrophotographic printing method, in which the transfer performance of multicolor toner image from a photosensitive drum to an intermediate transfer drum is excellent, cleaning means is provided to clean the photosensitive drum without impairing the life thereof, toner can be changed easily, and the generation of vaporized gas resulting from a liquid carrier is held to the smallest possible extent. The colors of toner image developed on the basis of the color-separated print information are yellow, magenta, cyan, and black, and yellow toner image is developed first, so that yellow toner image is fixed on the uppermost layer on a recording medium. Since the yellow toner image has higher light transmission than the toner of any other color, the resultant color image is clear, so that the print quality can be improved. The yellow toner image, being located on the lowermost layer on the intermediate transfer medium, has the highest possibility of remaining on the intermediate transfer medium without being transferred to the recording medium. However, the yellow toner image need not be cleaned because it is not so conspicuous.

We claim:

1. An electrophotographic printer comprising:

a photosensitive drum;

exposure means for forming an electrostatic latent image based on print information;

developing means for developing said electrostatic latent image on said photosensitive drum into a toner image by means of a wet toner;

a first squeeze roller for squeezing surplus wet toner adhering to said photosensitive drum, said first squeeze roller being set so that a contact angle at which a liquid carrier of said wet toner is in contact with a surface of said first squeeze roller is smaller than a contact angle at which said liquid carrier is in contact with a surface of said photosensitive drum;

transfer means for transferring said toner image onto a recording medium, which the toner image is to be transferred to and fixed on; and fixing means for fixing said toner image transferred on said recording medium onto said recording medium.

2. The electrophotographic printer of claim 1, further comprising a second squeeze roller for squeezing surplus wet toner adhering to said photosensitive drum.

3. The electrophotographic printer of claim 2, wherein said second squeeze roller is set so that a contact angle at which the liquid carrier of said wet toner is in contact with a surface of said second squeeze roller is smaller than the contact angle at which said liquid carrier is in contact with the surface of said photosensitive drum.

4. The electrophotographic printer of claim 1, wherein said first squeeze roller rotates in a direction opposite to the rotating direction of said photosensitive drum in the direction of a peripheral speed.

5. The electrophotographic printer of claim 1, wherein said developing means comprises a developing roller.

6. The electrophotographic printer of claim 1, wherein said developing means is capable of developing an electrostatic latent image on said photosensitive drum with toners of different colors.

7. The electrophotographic printer of claim 6, wherein said developing means includes a plurality of developing units having a developing roller and a squeeze roller for each said unit.

8. The electrophotographic printer of claim 1, wherein said transfer means includes an intermediate transfer medium pressed against said photosensitive drum so that the toner image on said photosensitive drum is transferred thereon; and a transfer roller.

9. The electrophotographic printer of claim 8, wherein said transfer roller serves also as said fixing means.

10. An electrophotographic printer comprising:

a photosensitive drum;

exposure means for forming an electrostatic latent image based on print information;

developing means for developing said electrostatic latent image on said photosensitive drum into a toner image by means of a wet toner;

a first squeeze roller for squeezing surplus wet toner adhering to said photosensitive drum, said first squeeze roller having a surface portion formed of a material selected from a group consisting of polyester resin, polypropylene resin, and polyurethane resin;

transfer means for transferring said toner image onto a recording medium, which the toner image is to be transferred to and fixed on;

fixing means for fixing said toner image transferred on said recording medium onto said recording medium; and a second squeeze roller for squeezing surplus wet toner adhering to said photosensitive drum.

11. An electrophotographic printer comprising:

a photosensitive drum;

exposure means for forming an electrostatic latent image based on print information;

developing means for developing said electrostatic latent image on said photosensitive drum into a toner image by means of a wet toner;

a first squeeze roller for squeezing surplus wet toner adhering to said photosensitive drum, said first squeeze roller having a surface portion formed of a material selected from a group consisting of polyester resin, polypropylene resin, and polyurethane resin;

transfer means for transferring said toner image onto a recording medium, which the toner image is to be transferred to and fixed on;

fixing means for fixing said toner image transferred on said recording medium onto said recording medium; and a second squeeze roller for squeezing surplus wet toner adhering to said photosensitive drum, wherein said second squeeze roller has a surface portion formed of a material selected from a group consisting of polyester resin, polypropylene resin and polyurethane resin.

* * * * *